United States Patent [19]

Meives et al.

[11] Patent Number: 4,610,125

[45] Date of Patent: Sep. 9, 1986

[54] METHOD AND APPARATUS FOR CONFINING WRAPPED REAMS OF PAPER SHEETS IN CARDBOARD BOXES

[75] Inventors: Otis E. Meives, Cleveland; Anthony Lutzke, Elkhart Lake, both of Wis.

[73] Assignee: PEMCO Inc., Sheboygan, Wis.

[21] Appl. No.: 730,872

[22] Filed: May 3, 1985

[51] Int. Cl.[4] ..... B65B 11/18

[52] U.S. Cl. ..... 53/462; 53/207; 53/564

[58] Field of Search ..... 53/462, 207, 564, 461, 53/209, 203

[56] References Cited

U.S. PATENT DOCUMENTS

| | | | |
|---|---|---|---|
| 3,120,727 | 2/1964 | Ziliox | 53/462 X |
| 3,585,776 | 6/1971 | Euwe | 53/462 X |
| 3,817,018 | 6/1974 | Vickers | 53/207 X |
| 3,896,601 | 7/1975 | Vickers et al. | 53/462 |

*Primary Examiner*—James F. Coan

*Attorney, Agent, or Firm*—Peter K. Kontler

[57] ABSTRACT

Successive stacks of wrapped reams of paper sheets are delivered onto first cardboard blanks on top of a first platform which is then maintained in raised position. The platform thereupon descends and the front and rear sidewalls of the blank are simultaneously pivoted against the respective sides of the descending stack before the latter leaves the first platform and continuously advances along a first horizontal path wherein the conversion of the first blank continues so that such blank ultimately constitutes a case surrounding the bottom and the sides of the respective stack. The stack is then lifted by a second platform and a second blank is placed on top of the ascending stack or even ahead of the second platform. The rising platform moves the second blank past a first set of folding devices which fold its front and rear flaps, and the stack thereupon continuously advances along a second horizontal path to complete the conversion of the second blank into a lid which overlies the top of the stack and is glued to the adjacent parts of the case. The effective width and height of the apparatus and the effective width of the hoppers for the first and second blanks are adjustable.

35 Claims, 25 Drawing Figures

METHOD AND APPARATUS FOR CONFINING WRAPPED REAMS OF PAPER SHEETS IN CARDBOARD BOXES

BACKGROUND OF THE INVENTION

The present invention relates to a method and apparatus for manipulating arrays of paper sheets or the like, and more particularly to improvements in a method and apparatus for introducing arrays of sheets into receptacles, especially into boxes of the type having a lower receptacle or case.

It is known to accumulate wrapped reams of paper sheets into piles or stacks and to introduce the thus obtained piles into receptacles. It is also known to build receptacles around piles of reams of paper sheets. An apparatus (a so-called wraparound case packer) of such type is manufactured and sold by the assignee of the present application and is known as Model 86.

A drawback of presently known apparatus for the confinement of piles or stacks of paper sheets is that their operation is too slow if they are to turn out boxes or analogous receptacles of prescribed size and/or shape and/or quality. Furthermore, the versatility of heretofore known apparatus is insufficient, i.e., these apparatus cannot be converted for the making of widely different products including boxes which contain predetermined numbers of wrapped reams consisting of smaller or larger sheets and/or reams which are assembled into a single row or several rows. Furthermore, presently known apparatus are rather bulky and all of their parts are not readily accessible.

OBJECTS AND SUMMARY OF THE INVENTION

An object of the invention is to provide a novel and improved method of confining arrays of paper sheets or the like in receptacles in a continuous operation so that large numbers of arrays can be boxed per unit of time.

Another object of the invention is to provide a method which renders it possible to provide arrays of paper sheets (e.g., arrays of six stacks of paper sheets each) with receptacles in a time- and space-saving operation and without contamination of and/or other damage to the arrays.

A further object of the invention is to provide a method which can be used to introduce into each receptacle a single array or a plurality of arrays of properly oriented sheet-like articles.

An additional object of the invention is to provide a method which can be automated to the desired extent and which can be utilized for the processing of small, large, medium-sized, stiff, soft, pressure-sensitive, unicolored, multicolored, thick and/or thin sheets of paper, synthetic plastic material or the like.

Still another object of the invention is to provide a method which ensures that the orientation of processed sheets is not changed at all or is changed only negligibly and/or infrequently to thus further reduce the likelihood of misorientation of sheets during introduction into and confinement in cardboard boxes or the like.

A further object of the invention is to provide a novel and improved apparatus for the practice of the above outlined method and to construct and assemble the apparatus in such a way that the apparatus can turn out large numbers of boxed commodities per unit of time.

Another object of the invention is to provide an apparatus wherein the commodities are boxed or packed while in continuous or substantially continuous motion so that the intervals of idleness are a fraction of those in conventional indexing apparatus.

A further object of the invention is to provide an apparatus which can process a wide variety of sheet-like commodities with the same degree of accuracy, facility and reproducibility.

Still another object of the invention is to provide an apparatus which can be used in production lines for the processing of sheet-like products as a superior substitute for heretofore known case packers.

An additional object of the invention is to provide the apparatus with novel and improved means for converting cardboard blanks or the like into receptacles for single or multiple arrays of stacked paper sheets or the like.

A further object of the invention is to provide the above outlined apparatus with novel and improved means for transporting successive arrays through a series of successive stations where the arrays are gradually confined in one-piece or composite receptacles consisting of cardboard or the like.

Another object of the invention is to provide the apparatus with novel and improved means for storing and feeding blanks of cardboard or the like to various stations wheresuch blanks are draped around arrays of stacked paper sheets or analogous commodities.

One feature of the present invention resides in the provision of a method of assembling commodities with components of confining means therefor, particularly of confining arrays of paper stacks in converted blanks which are made of cardboard or the like. The method comprises the first step of transporting successive commodities (e.g., arrays of n superimposed stacks of paper sheets) to a predetermined position at a first level, the second step of conveying successive components (e.g., blanks made of cardboard or the like) into register with the respective commodities in the predetermined position, the third step of jointly moving successive commodities and the respective components to a second level (e.g., to a lower level), the fourth step of advancing successive commodities and the respective components along a predetermined path (e.g., along a substantially horizontal path), and the fifth step of converting (not later than in the course of the fourth step) successive components into receptacles which partially surround the respective commodities (such receptacles can constitute lower halves of two-piece cardboard boxes for arrayed stacks of superimposed paper sheets).

The fourth step can include continuously advancing the commodities and the respective components along the predetermined path.

The method can further comprise the step of guiding successive commodities in the course of the first step so that each such commodity is transported to the same predetermined position.

The second step can include changing the orientation of successive components (such as the aforementioned cardboard blanks) during conveying toward the positions of register with the respective commodities. This can contribute to compactness of the apparatus which is used to practice the improved method. For example the second step can include changing the orientation of successive components through between 75 and 105 degrees, including moving each component from a substantially vertical plane into a substantially horizontal plane. Such second step can further include moving successive components in the horizontal plane toward the positions of register with the respective commodities.

The method can further comprise the sixth step of conveying successive second components of confining means (e.g., second blanks which are to be converted into covers overlying the receptacles and their contents) to a predetermined position of register with oncoming commodities and the respective receptacles in a predetermined portion of the path, the seventh step of jointly moving the second components with the respective commodities and receptacles to a third level, the eighth step of advancing the second components and the respective commodities and receptacles along a second path, and the ninth step of converting (not later than in the course of the eighth step) successive second components into second receptacles (e.g., the aforementioned covers) each of which at least partially surrounds the remaining portion of the respective commodity.

The eighth step can include uninterruptedly advancing the commodities, the respective receptacles and the respective second components along the second path.

The third level can be above the second level and the first level can be above the second level. At least one of the first and second paths is preferably at least substantially horizontal.

The method can further comprise the step of bonding each second receptacle to the corresponding first mentioned receptacle.

The sixth step can include changing the orientation of successive second components during conveying toward the predetermined portion of the first mentioned path; this can enhance the compactness of the apparatus which is used to practice the method. For example, the sixth step can include changing the orientation of successive second components through approximately or exactly 90 degrees, including moving each second component from a substantially vertical plane into a substantially horizontal plane. Such sixth step can further include moving successive second components in the horizontal plane toward a predetermined portion of the first mentioned predetermined path.

The ninth step can include converting a portion of each second component into a portion of the respective second receptacle in the course of the seventh step (i.e., while the second components and the respective commodities and receptacles move from the second to the third level). Analogously, the fifth step can include converting a portion of each first mentioned component into a portion of the respective first mentioned receptacle in the course of the third step (i.e., while successive commodities and the respective first mentioned components move jointly from the first to the second level).

Another feature of the invention resides in the provision of an apparatus for assembling commodities with components of confining means therefor, particularly for confining arrays of paper stacks in converted blanks of cardboard or the like. The apparatus comprises means for transporting successive commodities of a series of such commodities to a predetermined position at a first level, means for conveying successive components of a series of components (each such component can constitute a cardboard blank which is convertible into the lower half or part of a two-piece box for storage of a preselected number of superimposed paper stacks) into register with successive commodities in the predetermined position, means for jointly moving successive commodities and the respective components from the first level to a different second level (above or below the first level), means for advancing successive commodities and the respective components along a predetermined path, and means for converting (not later than in the predetermined path) successive components into receptacles which partially surround the respective commodities.

The moving means can comprise means for lowering successive commodities and the respective components from the first to the second level, and the predetermined path is or can be at least substantially horizontal.

The apparatus can further comprise guide means cooperating with the transporting means to ensure that each of a short or long series of commodities is transported to the same predetermined position.

The converting means can include a portion which is adjacent to the moving means so that a portion of each component is converted into a portion of the respective receptacle during movement with the respective commodity from the first to the second level.

The advancing means can comprise means for continuously advancing successive commodities and the respective components long the predetermined path.

The conveying means can comprise means for changing the orientation of successive components on their way toward positions of register with the respective commodities in the predetermined position. Such orientation changing means can comprise means for moving successive components of the series from a substantially vertical plane into a substantially horizontal plane, and the conveying means preferably further comprises means for conveying successive components in the horizontal plane toward positions of register with the respective commodities in the predetermined positions. The conveying means can comprise means for placing successive components of the aforementioned series on top of the respective commodities in the predetermined position.

The apparatus can further comprise means for conveying successive second components (each second component can constitute a second cardboard blank which can be converted into the upper half of a cardboard box for an array of stacked paper sheets or the like) of a series of second components to a predetermined position in a predetermined portion of the path downstream of the converting means so that each second component is in register with the oncoming commodity and the respective receptacle, means for jointly moving successive second components with the corresponding receptacles and commodities from the second level to a different third level above or below the second level, means for advancing successive second components (together with the corresponding receptacles and commodities) along a second predetermined path, and means for converting (not later than in the second path) successive second components into second receptacles each of which at least partially surrounds the remaining portion of the respective commodity. The means for advancing second components, the corresponding receptacles and the corresponding commodities along the second path preferably includes means for uninterruptedly advancing successive second components, the corresponding receptacles and the respective commodities along the second path.

The means for jointly moving successive second components with the corresponding receptacles and commodities from the second to the third level can comprise means for lifting successive second components, the corresponding receptacles and the respective commodities from the second level to the third level.

The second path is or can be at least substantially horizontal.

The means for converting the second components into second receptacles preferably comprises a portion which is adjacent to the means for moving successive second components from the second level to the third level so that a portion of each second component is converted into a portion of the respective second receptacle during movement with the respective commodity and first mentioned receptacle from the second level to the third level.

The means for conveying a series of second components to a predetermined position in a predetermined portion of the path downstream of the first converting means preferably comprises means for changing the orientation of second components on their way toward the predetermined portion of the first mentioned predetermined path, and such orientation changing means preferably comprises means for moving successive second components from a substantially vertical plane into a substantially horizontal plane. The just discussed conveying means preferably further comprises means for conveying successive second commodities in the horizontal plane toward and into the predetermined portion of the first mentioned predetermined path. Such conveying means can comprise means for placing sucessive second components of the respective series on top of the corresponding commodities in the predetermined portion of the first mentioned predetermined path.

The apparatus can further comprise means for bonding each second receptacle to the respective first mentioned receptacle.

The means for conveying successive components of a series of first mentioned components can comprise means for placing successive components of the series below the corresponding commodities in the predetermined position.

Still further, the apparatus can comprise a source of supply of commodities and means for singularizing the commodities of the respective series between the source and the predetermined position.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
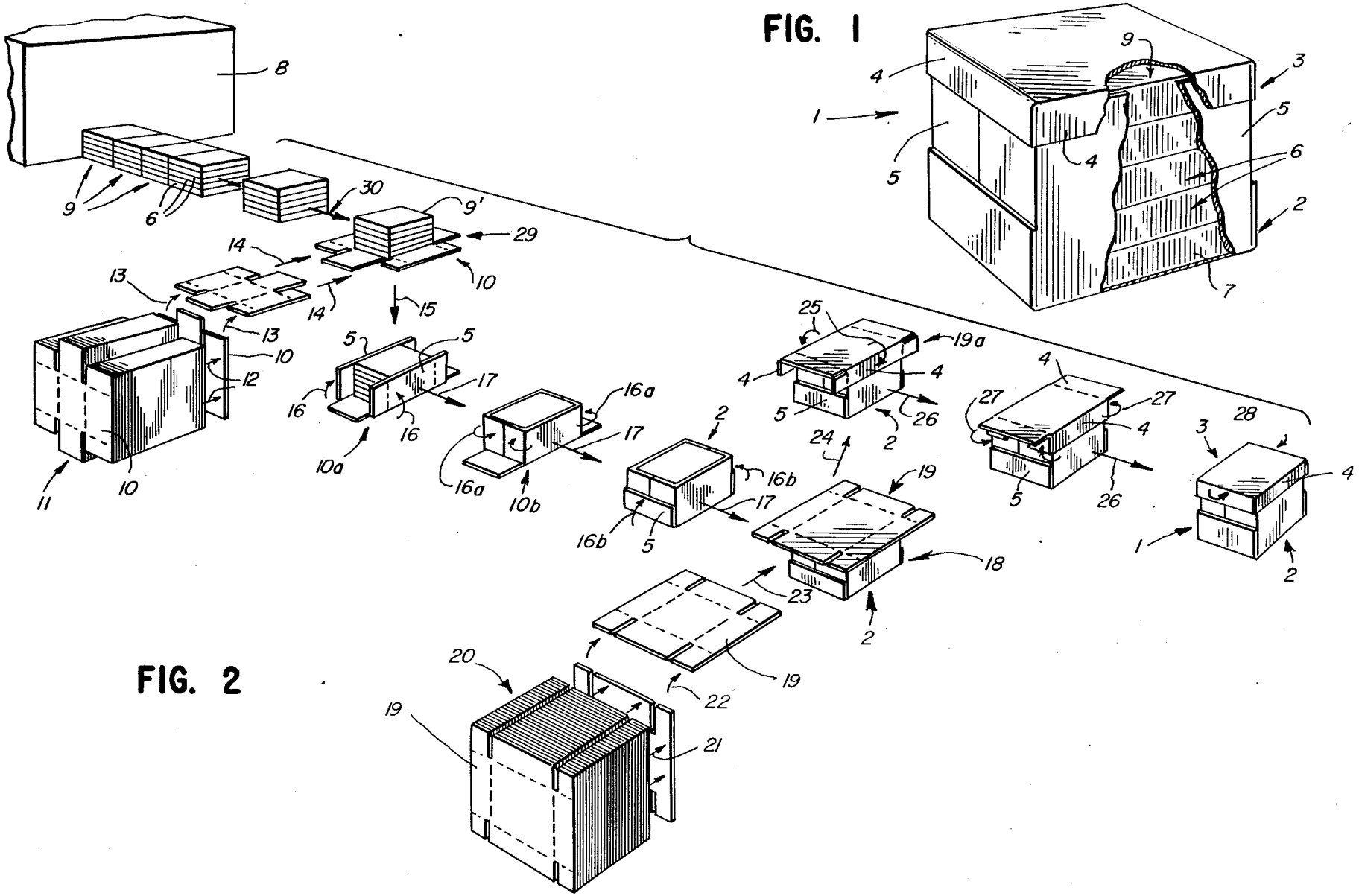
FIG. 1 is a perspective view of a cardboard box which is assembled in the apparatus of the present invention, portion of case and lid being broken away to show the confined pile of five superimposed wrapped reams of paper sheets.
FIG. 2 is a diagrammatic perspective view of the sequence of steps in accordance with a first embodiment of the improved method.

Referring first to FIG. 1, there is shown a container in the form of a box 1 which includes a lower receptacle or case 2 and an upper receptacle or lid 3. The downwardly extending flaps 4 of the lid 3 are bonded to the adjacent folded flaps 4 by a suitable adhesive. The case 2 may but normally need not be bonded to the lid 2. The box 1 contains a single array or pile 9 of commodities in the form of stacks 6, and each such stack consists of a given number of overlapping paper sheets confined in a paper wrapper 7. The box 1 can be designed to accommodate several (e.g., two) piles of stacks 6 side by side. This depends on the dimensions of stacks 6 and on the desired dimensions of the box.

The stacks 6 can be accumulated into piles, which are ready for boxing, in a suitable ream stacker/accumulator (such as the Model 134 or 135, both manufactured and sold by the assignee of the present application) which constitutes a source of supply of piles.

The basic mode of operation of one presently preferred embodiment of the improved apparatus is shown in FIG. 2. The ream stacker/accumulator 8 discharges a row of aligned piles 9 each of which contains a predetermined number (e.g., five) of superimposed stacks 6. The piles 9 are singularized during advancement along a horizontal path (note the arrow 30), and successive singularized piles 9 reach a predetermined position 9' at a first level which is or can be the level of the row of piles 9 issuing from the stacker/accumulator 8. Of course, it is also possible to place the stacker/accumulator 8 at a different level and to move the piles 9 up or down before they reach the level of the pile which assumes the predetermined position 9' at a station 29. Such pile is then located on top of a component 10 of confining means for the respective pile, namely on a blank which is made of cardboard, corrugated paper or the like and is cut to size as well as provided with fold lines and slits to facilitate its conversion into a case 2.

The blank 10 is withdrawn from a first hopper 11 which is laterally adjacent to the path of movement of piles 9 from the stacker/accumulator 8 toward the discharge or outlet end of the apparatus. The piles 9 advance in a single plane and are caused to move in such plane up and down but not sideways. This is desirable and advantageous because the stacks 6 of a pile are less likely to shift and also because the width of the apparatus can be reduced accordingly. The hopper 11 contains a supply of neighboring blanks 10 which are disposed in substantially vertical planes. Successive foremost blanks 10 are or can be lifted in their planes at an angle to the vertical (arrows 12), turned through an angle normally not exceeding 90 degrees (e.g., 80 degrees) into a horizontal plane (arrows 13) and moved (arrows 14) transversely of the direction of advancement of the piles 9 to a predetermined position below the pile 9 which occupies the position 9' at the station 29. Such pile then overlies the central portion of the blank 10 therebelow, namely the portion which is to constitute the bottom panel of the case 2.

The stacker/accumulator 8 and/or the improved apparatus is provided with guide means (not shown in FIG. 2) serving to ensure that each of a short or long series of successive piles 9 is caused to assume the same predetermined position 9', namely an optimum position of register with the respective blank 10.

The pile 9 (in the position 9') and the blank 10 therebelow are then caused to move to a different level namely downwardly as indicated by the arrow 15 and, at the same time, the front and rear panels of the descending blank 10 are folded upwardly against the respective (front and rear) sides of the descending pile 9 so as to form the corresponding front and rear sidewalls 5 of the incipient case 2. This is indicated by the arrows 16. The partially converted blank **10*a* and the respective pile 9 then advance along an elongated horizontal path (arrows 17) in the same direction as that indicated by the arrow 30 but at a different (lower) level. The advancement of the blank 10*a* and of the pile 9 in the direction which is indicated by the arrows 17 is continuous (rather than stepwise or intermittent), and the blank 10*a* is acted upon by a variety of folding and tucking instrumentalities which convert it (see the arrows 16*a* and 16*b*) first into a blank 10*b* with partially completed lateral sidewalls and thereupon into a case 2 with completed lateral sidewalls 5 (each lateral sidewall includes two coplanar inner panels which directly abut against or are directly adjacent to the respective lateral side of the confined pile 9 and an outer panel which overlies and is bonded to the respective inner panels to ensure that the resulting case 2** retains its shape).

The case 2 and its contents (pile 9) advance into a predetermined portion of their common path (at a station 18) and to a position of accurate register with a second prefabricated blank 19 (whose material can be the same as that of the blanks 10) which is withdrawn from a hopper 20 in the same way as described in connection with the blanks 10 and hopper 11. Thus, the blanks 19 in the hopper 20 are located in substantially vertical planes; they are thereupon shifted partly upwardly and partly sideways (as indicated by the arrows 21); they are thereupon caused to change their orientation through an angle normally not exceeding 90 degrees (arrows 22), e.g., 80 degrees, and are advanced (arrow 23) at right angles to the direction of travel of piles 9 and associated blanks **10*a*, 10*b* and cases 2 (arrows 17) to positions of exact overlap with the piles 9 arriving at the station 18**.

In the next step, the case 2 which has arrived at the station 18 is moved to a different level (arrow 24), namely to a higher level which may but need not be the level of the piles 9 advancing from the stacker/accumulator 8 toward positions of register with successive blanks 10. At the same time, the front and rear flaps 4 of the blank 10 on top of the ascending pile 9 and case 2 are folded over the respective (front and rear) sidewalls 5 of the case 2. This is indicated by the arrows 25. The next step involves advancement of the case 2, of the pile 9 therein and of the respective partially converted blank **19*a* along a second elongated horizontal path (arrows 26) which is parallel to and is disposed at a level above the path denoted by the arrows 17. The partially converted blank 19*a* is subjected to additional treatments by a series of suitably configurated folding and tucking instrumentalities which fold the end portions of the front and rear flaps 4 against the outer sides of the respective lateral sidewalls 5 of the case 2 (atrows 27) to convert the blank 19*a* into a blank 19*b*, and the blank 19*b* is thereupon converted into a lid 3 in that its lateral flaps 4 are folded downwardly (see the arrows 28) over the respective end portions of the front and rear flaps 4 and are bonded to the front and rear flaps by means of a suitable adhesive. The finished container or box 1 (which contains a pile 9 of five stacks 6) is then evacuated from the apparatus, e.g., by one or more belt conveyors which can deliver boxes 1 into or onto a vehicle, to a further processing station (e.g., to a station where the boxes 1** are provided with straps or the like) or to storage.

In the presently preferred embodiment of the improved apparatus, the elevator 52 (FIG. 6C) which serves to lift successive cases 2 above and away from the station 18 is constructed and mounted in such a way that successive cases 2 which arrive at the station 18 are not brought to a full stop but continue to advance in the direction of arrows 17 while simultaneously moving from the level of the station 18 to the level of the partially converted blank **19*a* shown in FIG. 2. Such composite (partially upward and partially forward) movement of the cases 2 and blanks 19 is effected by the elevator 52 jointly with an endless belt or chain conveyor 33 (see FIG. 4) which has a set of motion transmitting fingers 33*a* serving to push successive cases 2 in the direction of the arrows 17 while the elevator 52 lifts such cases to the higher level. The just described composite movement of cases 2 with the elevator in indicated in FIG. 2 by the slight inclination of the arrow 24. By way of example, a case 2 on the elevator 52 can cover a distance of less than 20 inches (e.g., approximately 10 inches) while advancing in the direction which is indicated by the arrows 17 and while simultaneously moving from the level of the station 18 to the level of the partially converted blank 19*a* shown in FIG. 2**.

The just discussed absence of complete stoppage of successive cases 2 and their contents at the station 18 and/or of a very pronounced reduction of the speed of forward movement of the cases 2 in the direction which is indicated by the arrows 17 has been found to contribute significantly to an increased output of the improved apparatus and to a pronounced reduction of noise.

The apparatus of FIG. 2 can be modified by locating the station (29) for the pile 9 which assumes the predetermined position 9' at a level below the path which is indicated by the arrows 17 and/or by locating the station 18 at a level above the path which is denoted by the arrows 26. Moreover, successive second blanks 19 can reach the path of the blanks 10 and the respective piles 9 ahead of the station 18, i.e., ahead of the locus where the finished cases 2, the piles 9 therein and the respective second blanks 19 are caused to move from the level of the station 18 to a different level above or below such station. Analogously, successive piles 9 arriving from the stacker/accumulator 8 can be caused to overlie the respective blanks 10 ahead of the station 29 where the blanks 10 and the respective piles 9 descend (arrow 15 in FIG. 2).

Figure 2A:
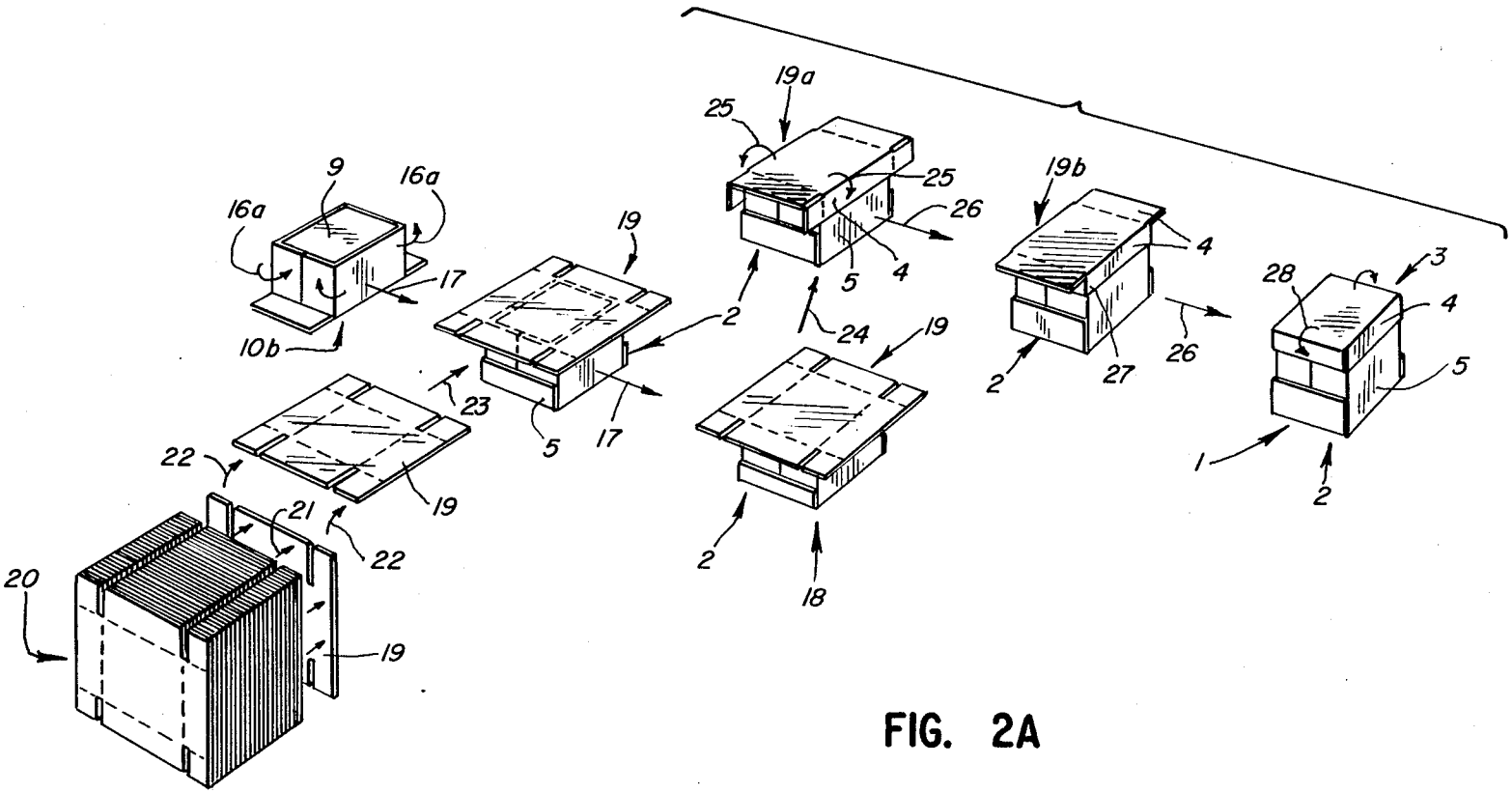
FIG. 2A is a perspective view showing a series of piles of reams, first and second blanks which are manipulated in accordance with a slightly modified method.
Figure 3:
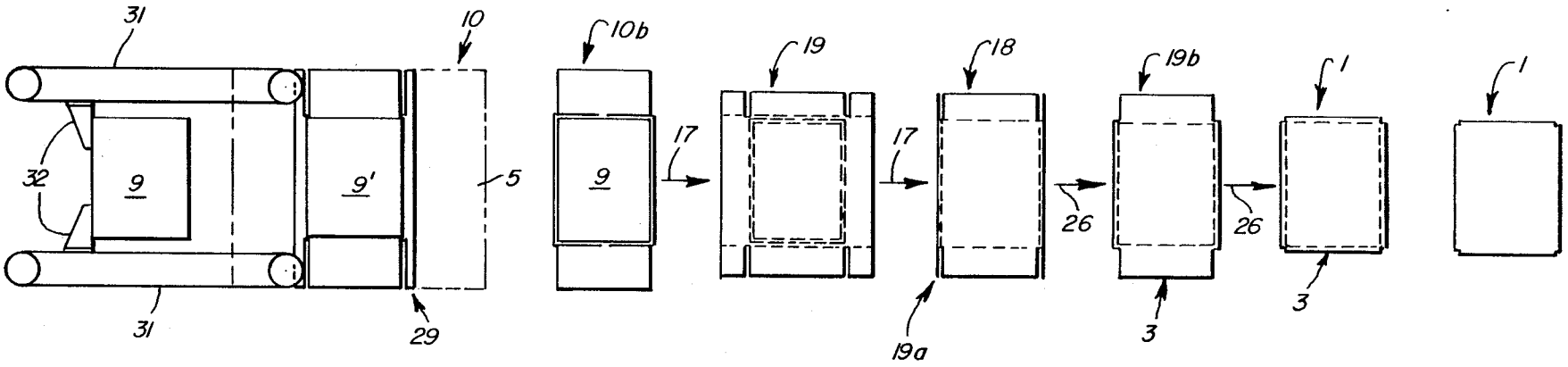
FIG. 3 is a plan view of a series of piles of reams, upper blanks and lower blanks which are treated in accordance with the modified method.
Figure 4:
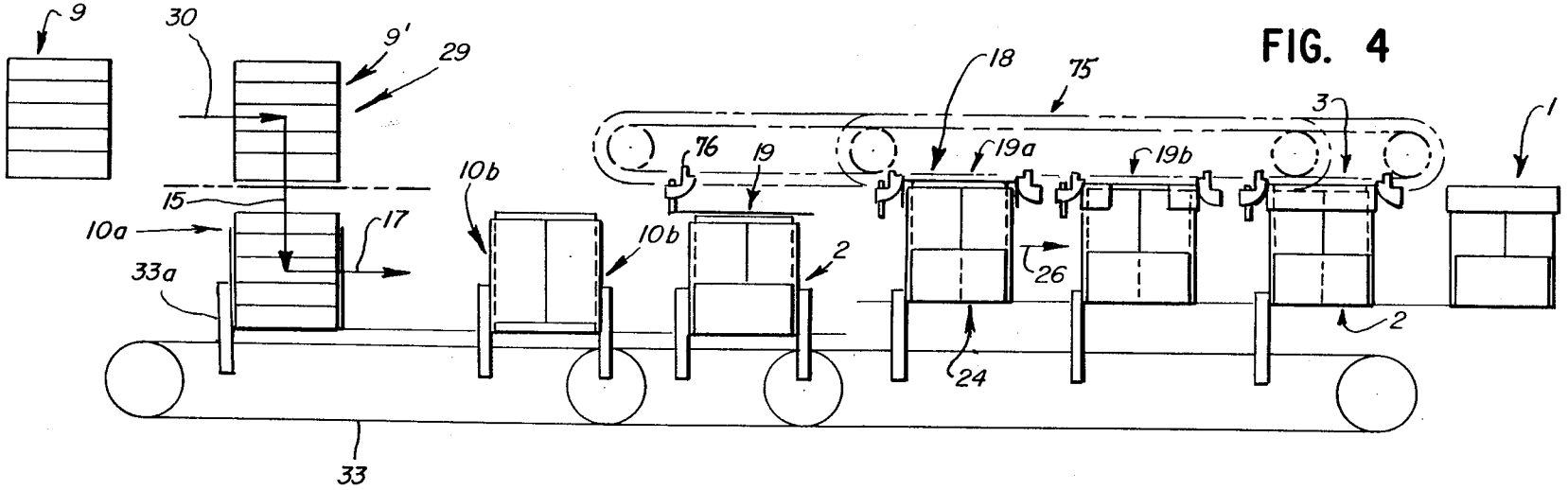
FIG. 4 is a side elevational view of the structure which is shown in FIG. 3.

The feature that successive second blanks 19 can be moved to positions of register with the oncoming piles 9 ahead of the station 18 is shown in FIGS. 2A, 3 and 4. It will seen that a fresh (underformed) blank 19 reaches the horizontal path of the respective pile 9 and associated converted blank 10*b* (case 2) before such pile reaches the station 18, and the blank 19 then advances with the associated case 2 and pile 9 in the direction indicated by arrows 17 (toward the station 18) before the case 2 and the pile 9 therein are lifted as indicated by the arrow 24. FIG. 3 further shows two singularizing conveyors 31 with pushers 32 which serve to deliver successive discrete piles 9 to the station 29 where such piles assume the positions 9′ for accurate registry with the oncoming blanks 10. FIG. 4 shows the continuously driven conveyor 33 which serves to advance successive lowered piles 9 and the corresponding blanks 10*a*, 10*b* and cases 2 along the horizontal path (arrow 17). The conveyor 33 has pushers 33*a* which advance the blanks 10*a*, 10*b* and the cases 2 along the path which is denoted by arrows 17 as well as along the path which is denoted by arrows 26.

FIG. 4 shows quite clearly that the piles 9 remain in a single vertical plane during movement from the stacker/accumulator 8 all the way to the outlet of the apparatus. This contributes to compactness of the apparatus.

Figure 6A:
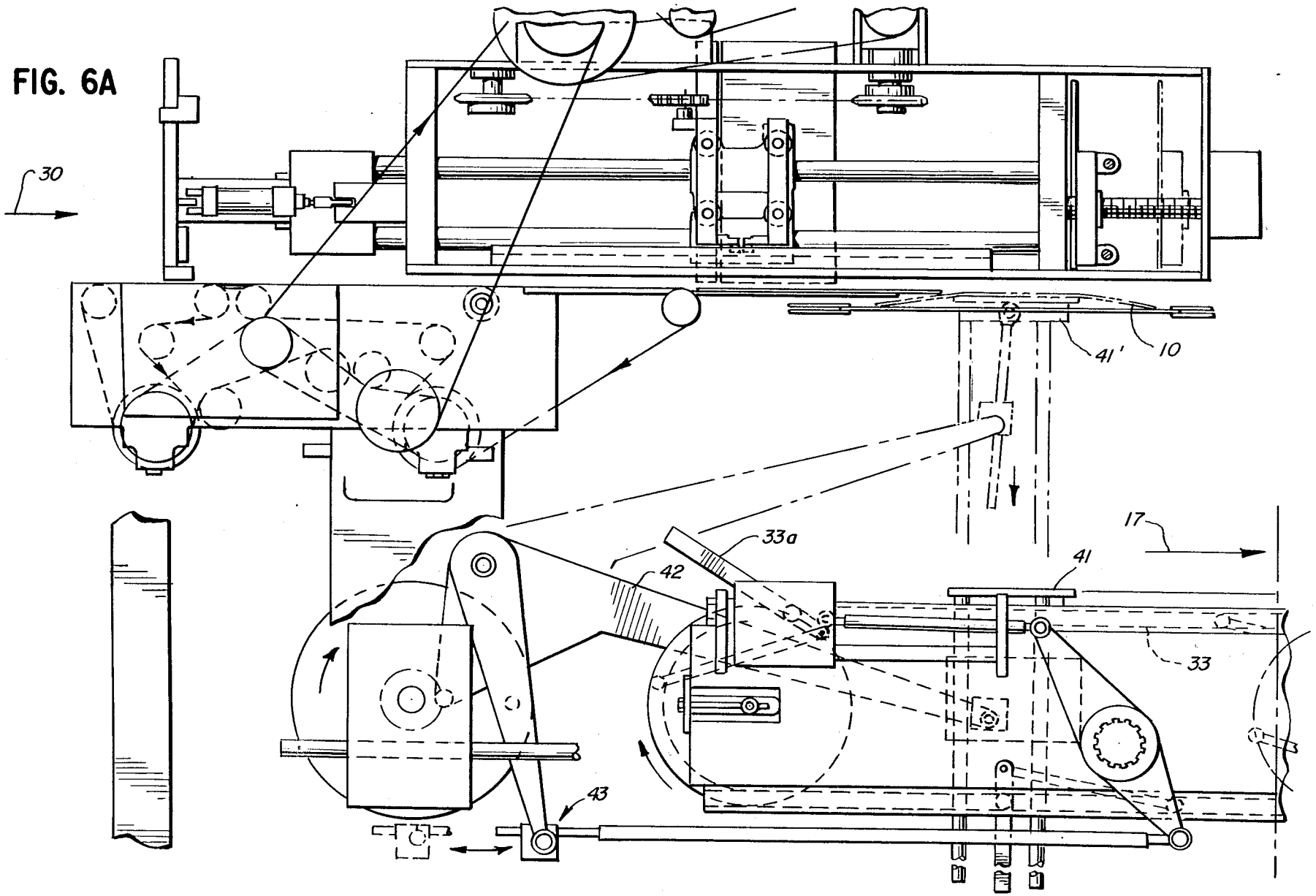
FIGS. 6A, 6B, 6C and 6D are fragmentary elevational views of the apparatus, with the hoppers for the first and second blanks omitted.
Figure 7A:
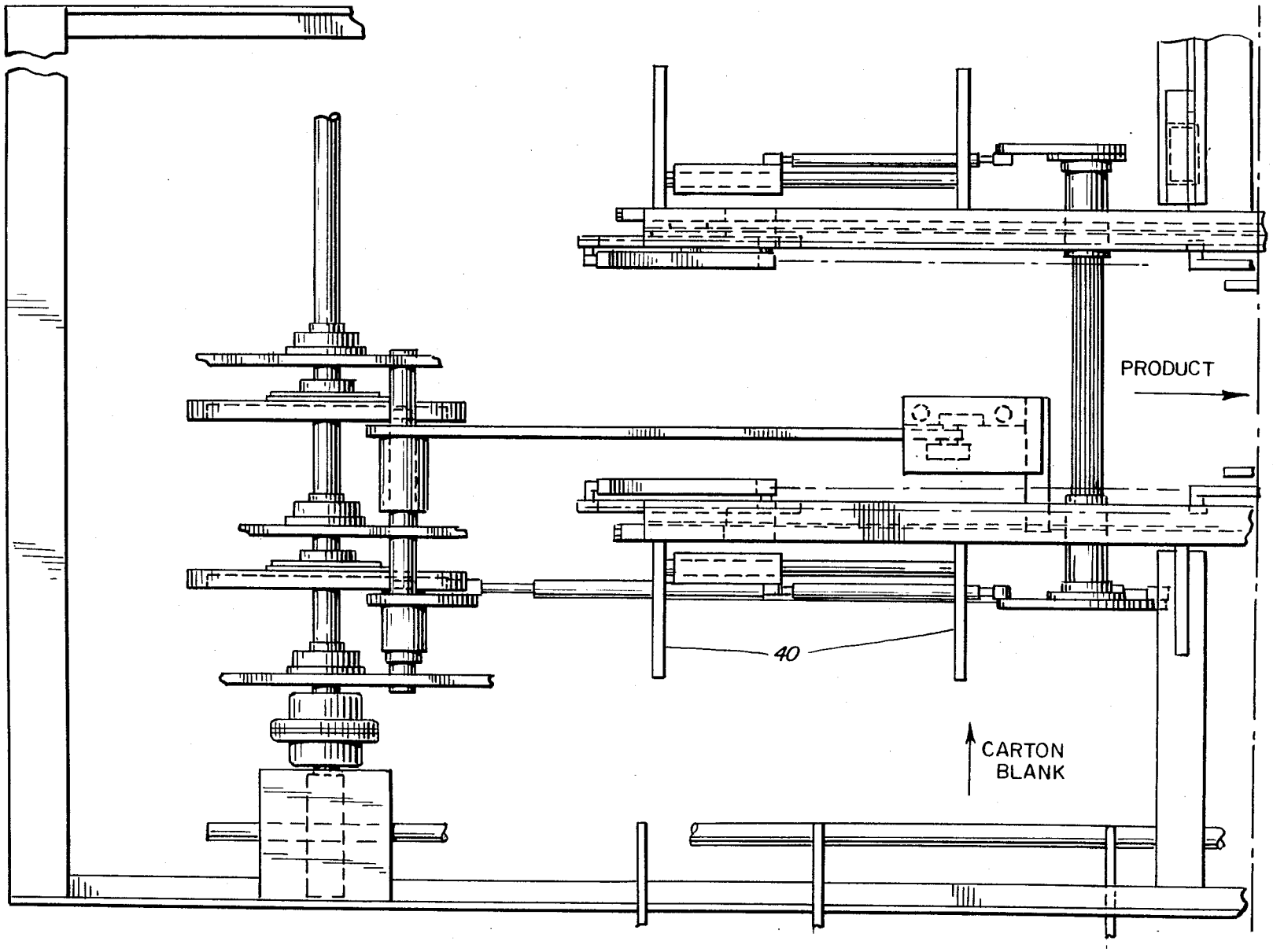
FIGS. 7A, 7B, 7C and 7D are fragmentary plan views of the apparatus as seen downwardly below the uppermost level of the apparatus.
Figure 11:
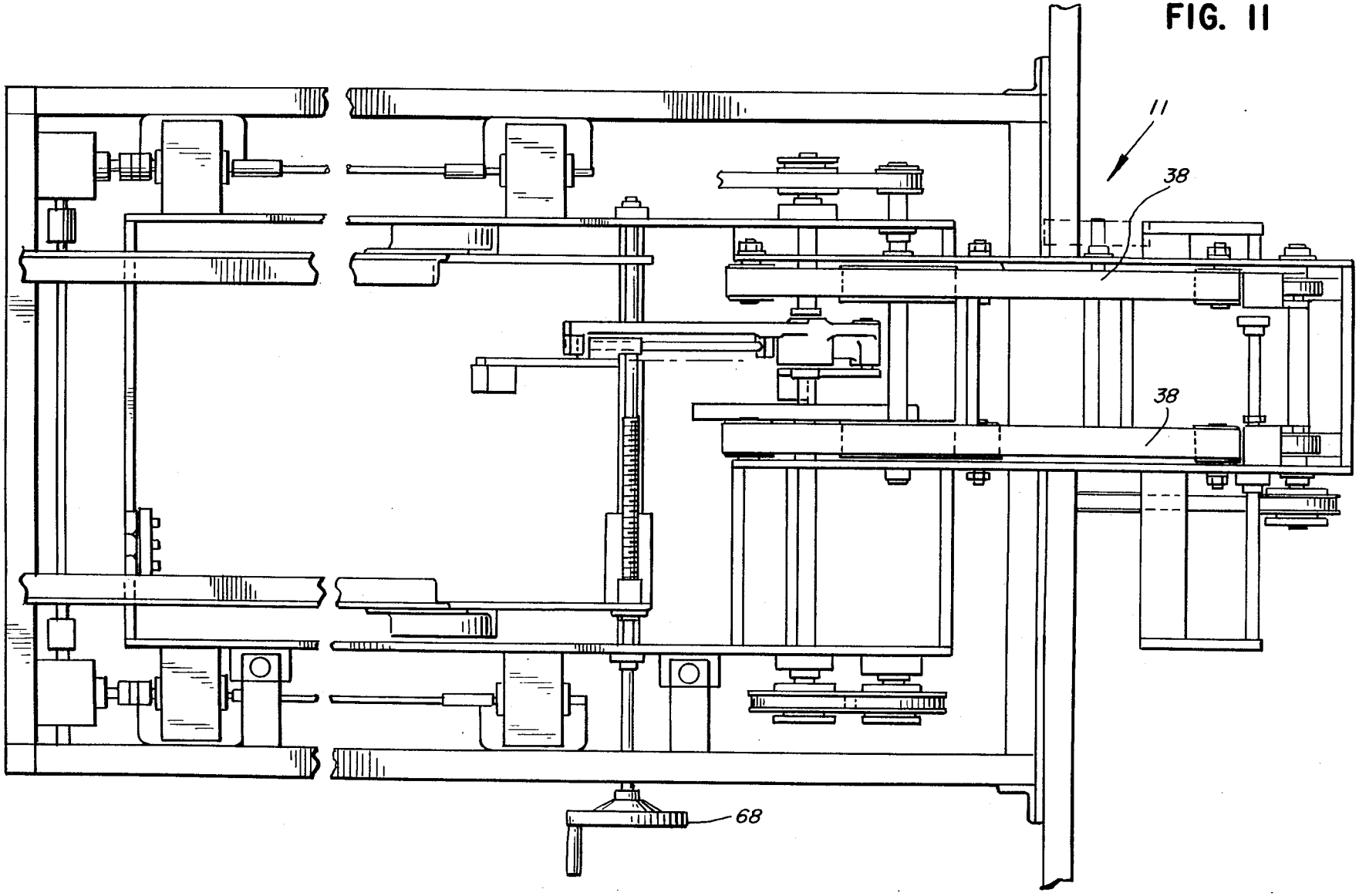
FIG. 11 is a plan view of one of the hoppers.
Figure 12:
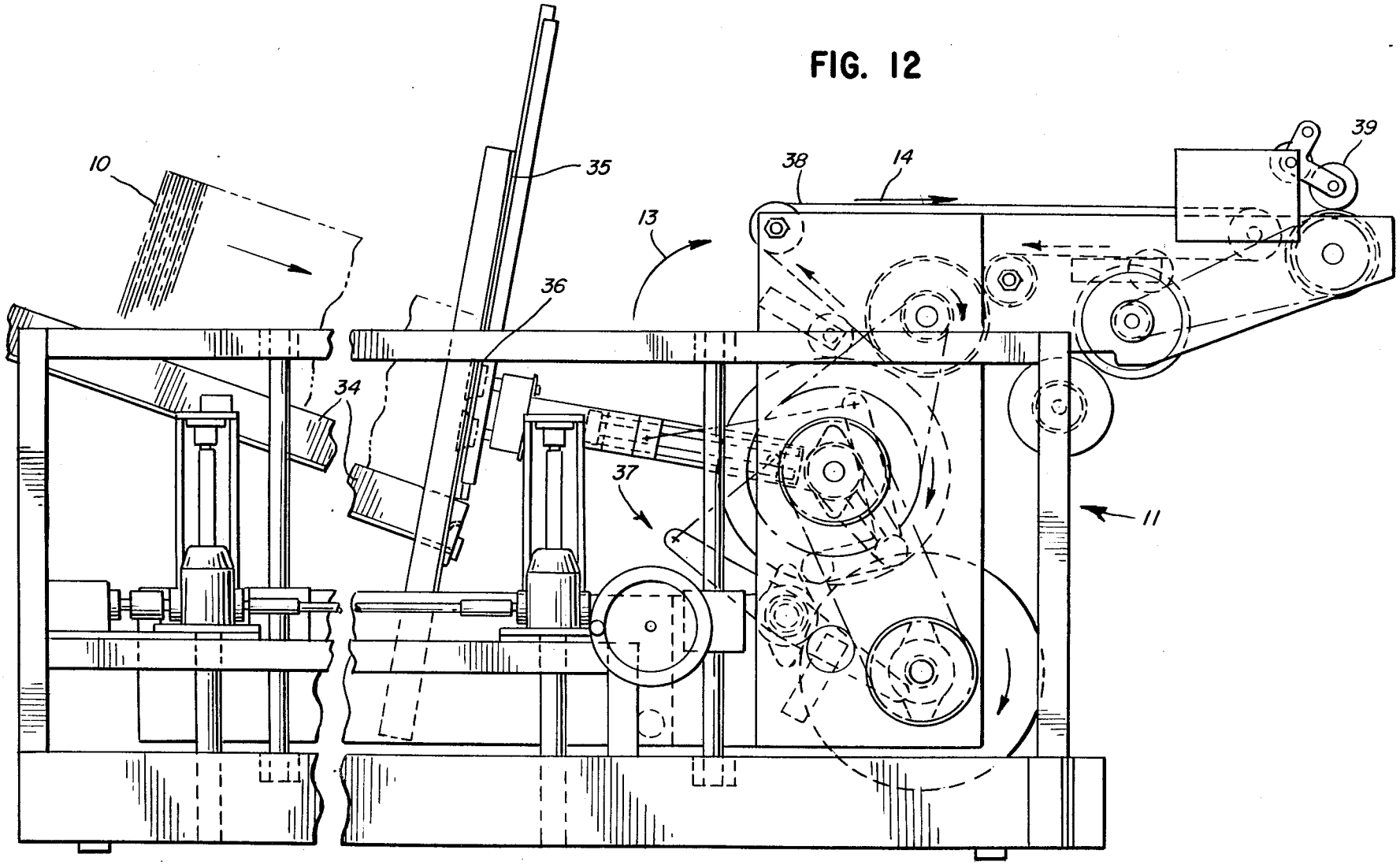
FIG. 12 is an elevational view of the hopper of FIG. 11.
Figure 13:
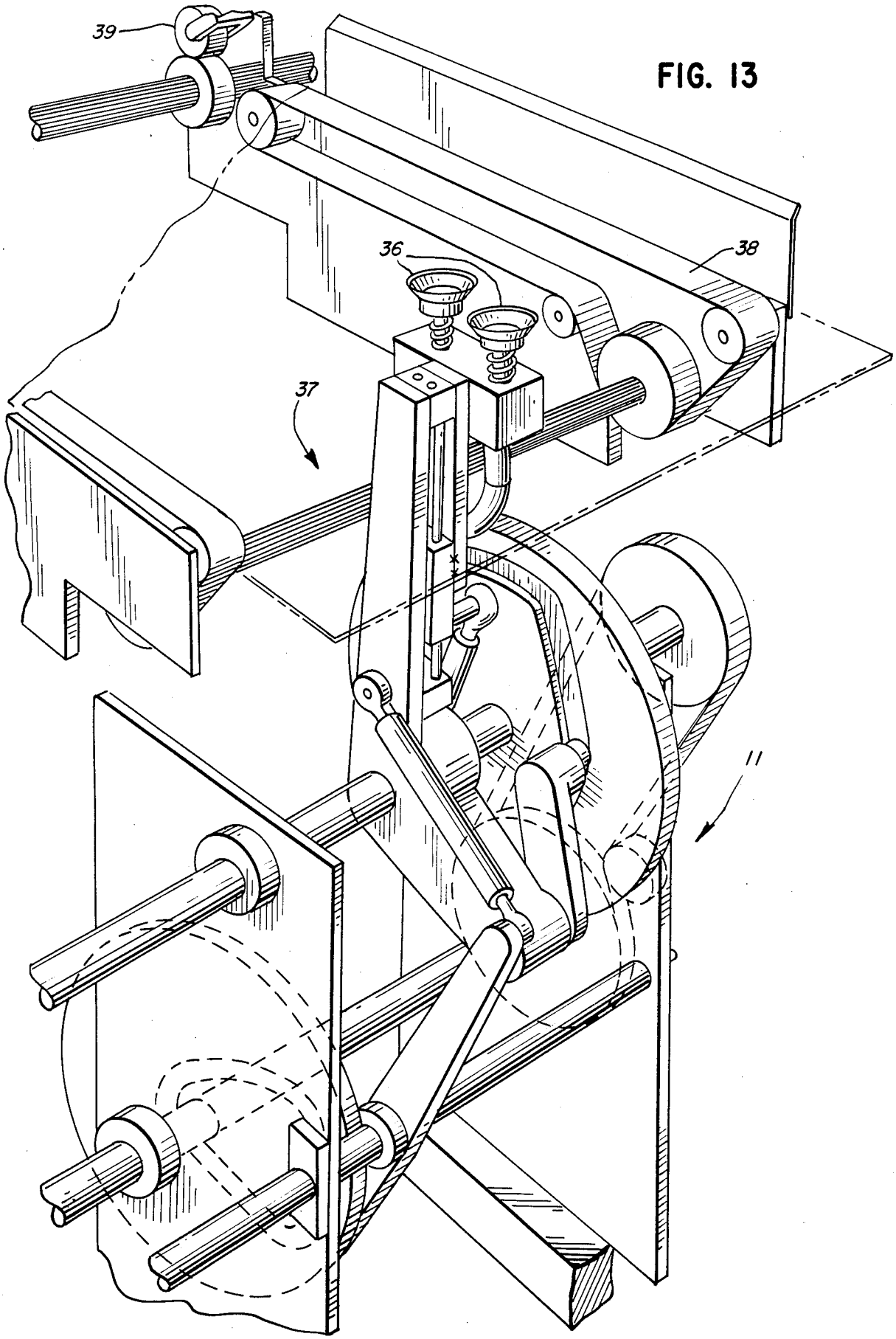
FIG. 13 is an enlarged fragmentary perspective view of certain details in the hopper of FIGS. 11 and 12.
Figure 14A:
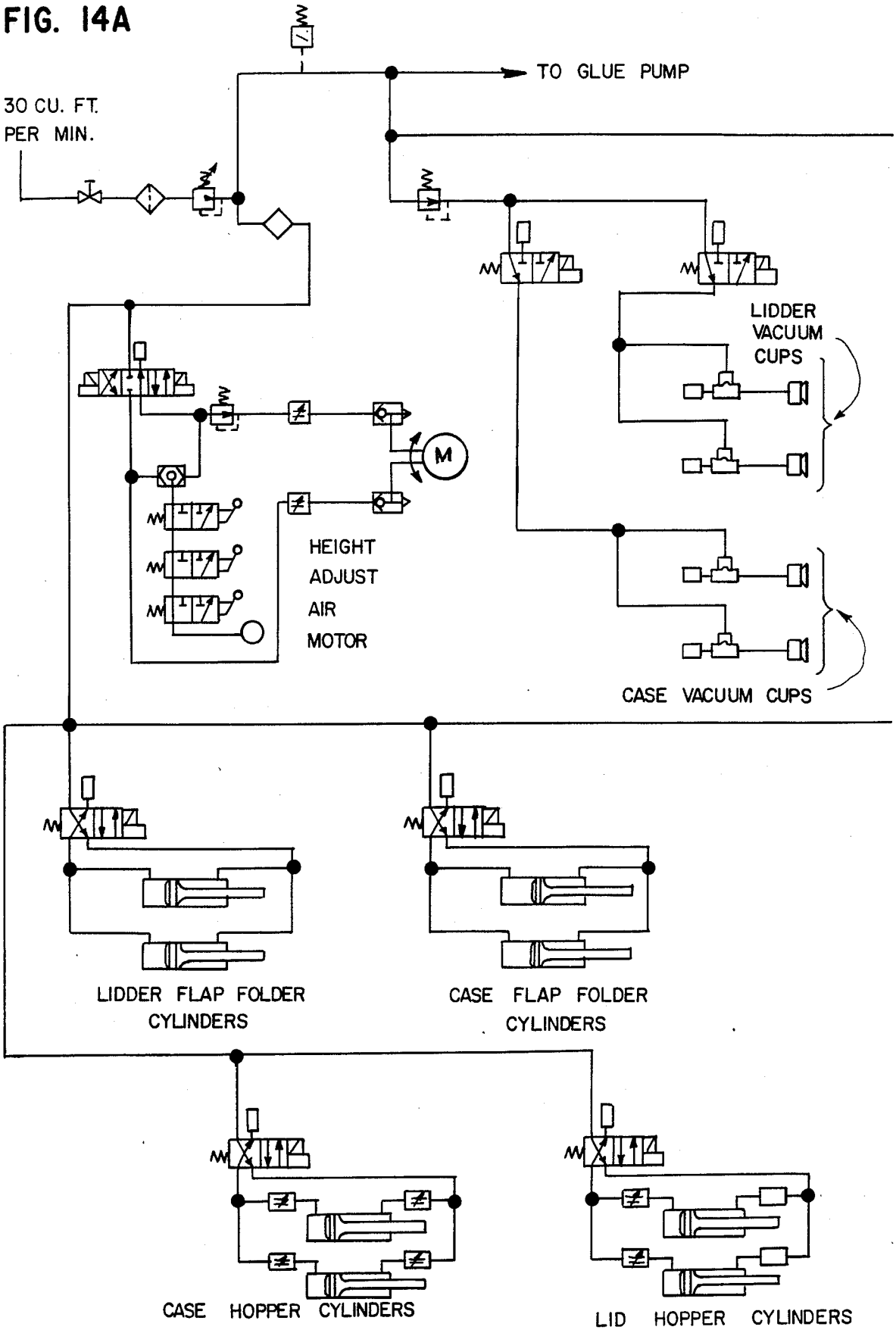
FIGS. 14A and 14B are diagrams showing certain details of the controls of the apparatus.
Figure 14B:
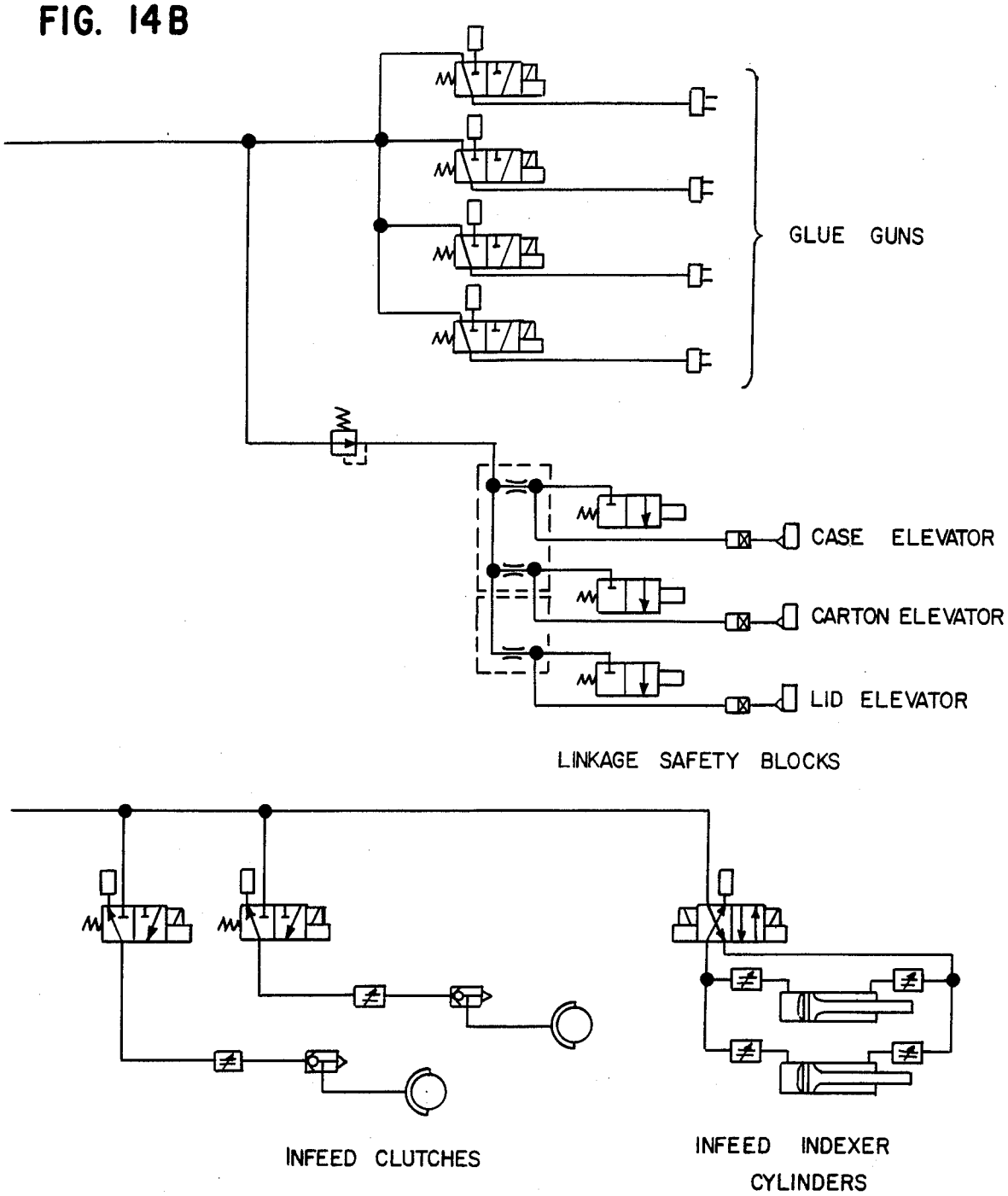

The details of the first hopper 11 for case blanks 10 are shown in FIGS. 11, 12 and 13. This hopper comprises a sloping ramp 34 of adjustable width which supports a supply of blanks 10 in vertical or nearly vertical planes. The foremost blank 10 of the supply on the ramp 34 abuts against a stop 35 which engages only the lateral flaps of such foremost blank so that the latter can be extracted by a pair of suction cups 36 which are movable along an arcuate path by an actuating mechanism 37 so as to change the orientation of the engaged blank 10 (note the arrows 13) and to deliver the blank onto the upper reaches of two spaced apart endless belt conveyors 38 whereon the thus reoriented blank 10 advances along a substantially horizontal path (arrows 14) and on to the station 29. The discharge ends of the upper reaches of the belt conveyors 38 cooperate with pinching rolls 39 which ensure predictable delivery of successive blanks 10 to the station 29, i.e., to optimum positions with reference to successive piles 9 which assume the positions 9′ prior to descent with a first or front platform or elevator 41 (FIG. 6A). The last stage of advancement of successive blanks 10 to the station 29 is controlled by guide rails 40 (see FIG. 7A).

Figure 10:
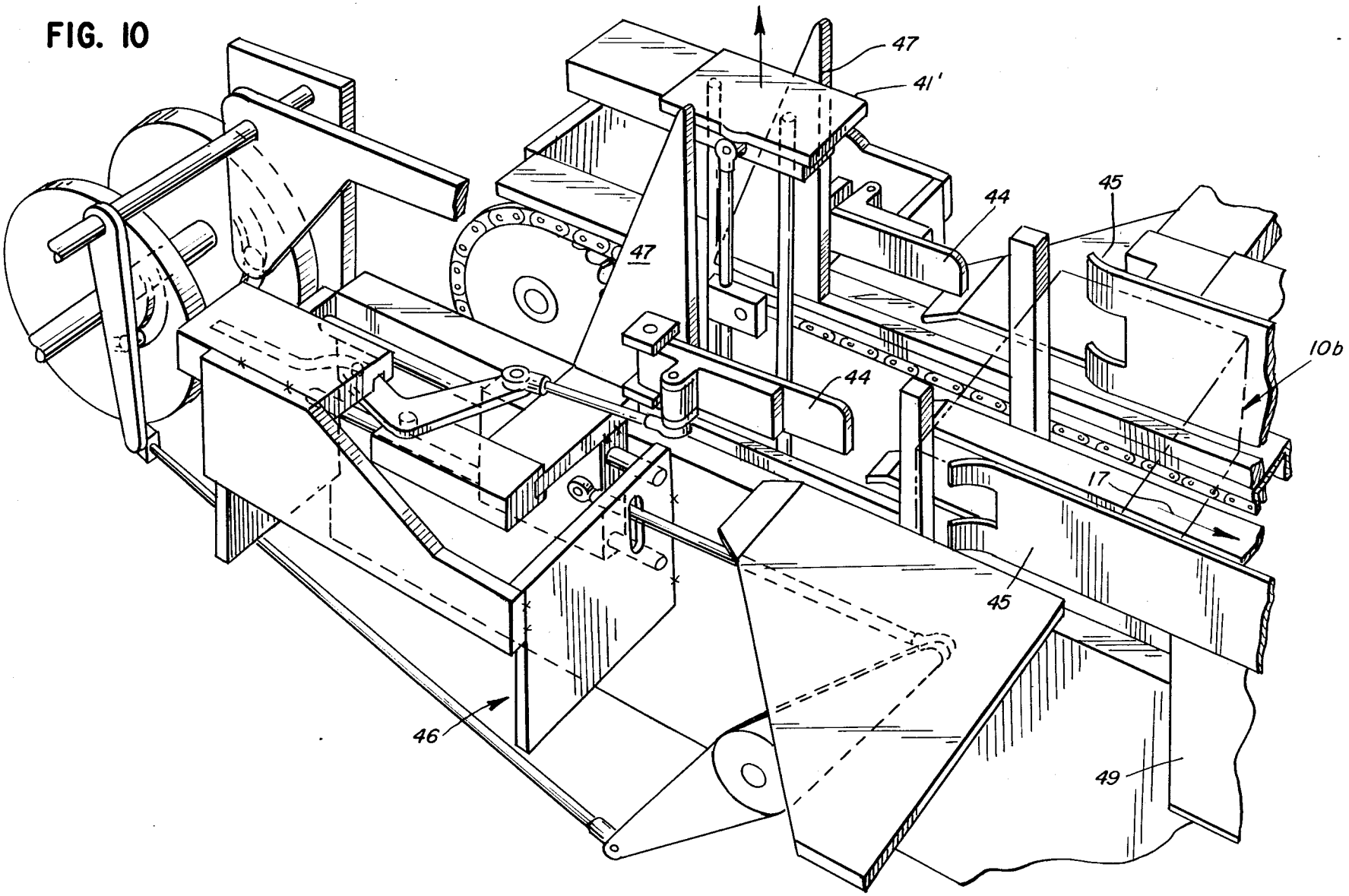
FIG. 10 is a fragmentary perspective view of the station for the first elevator.

The means for moving the platform 41 up and down is shown in FIG. 6A. Such moving means comprises a lifting arm 42 which is pivotable by a mechanism 43 to move the platform between the solid-line lower end position and the phantom-line upper end position 41′ of FIG. 6A. The lifted platform 41 descends with the blank 10 and a pile 9 thereon whereby two stationary folding arms (not specifically shown) which are adjacent to the path of downward movement of the platform 41 fold the front and rear sidewalls 5 of the descending blank 10 upwardly (arrows 16 in FIG. 2) so as to convert the blank 10 into the modified blank 10*a* not later than when the platform 41 reaches its lower end position. At such time, two pivotable tuckers 44 (FIG. 10) pivot the end portions of the rear sidewall 5 forwardly and, shortly or immediately thereafter (when the blank 10*a* begins to move in the direction of arrows 17 shown in FIG. 2), the lateral end portions of the front sidewall 5 of the blank 10*a* are folded rearwardly (note the arrows 16*a* in FIG. 2) by two stationary tucking rails 45. The tucking fingers 44 are mounted in the frame 46 of the apparatus on mobile carriers 47. All this can be best seen in FIG. 10.

Figure 6B:
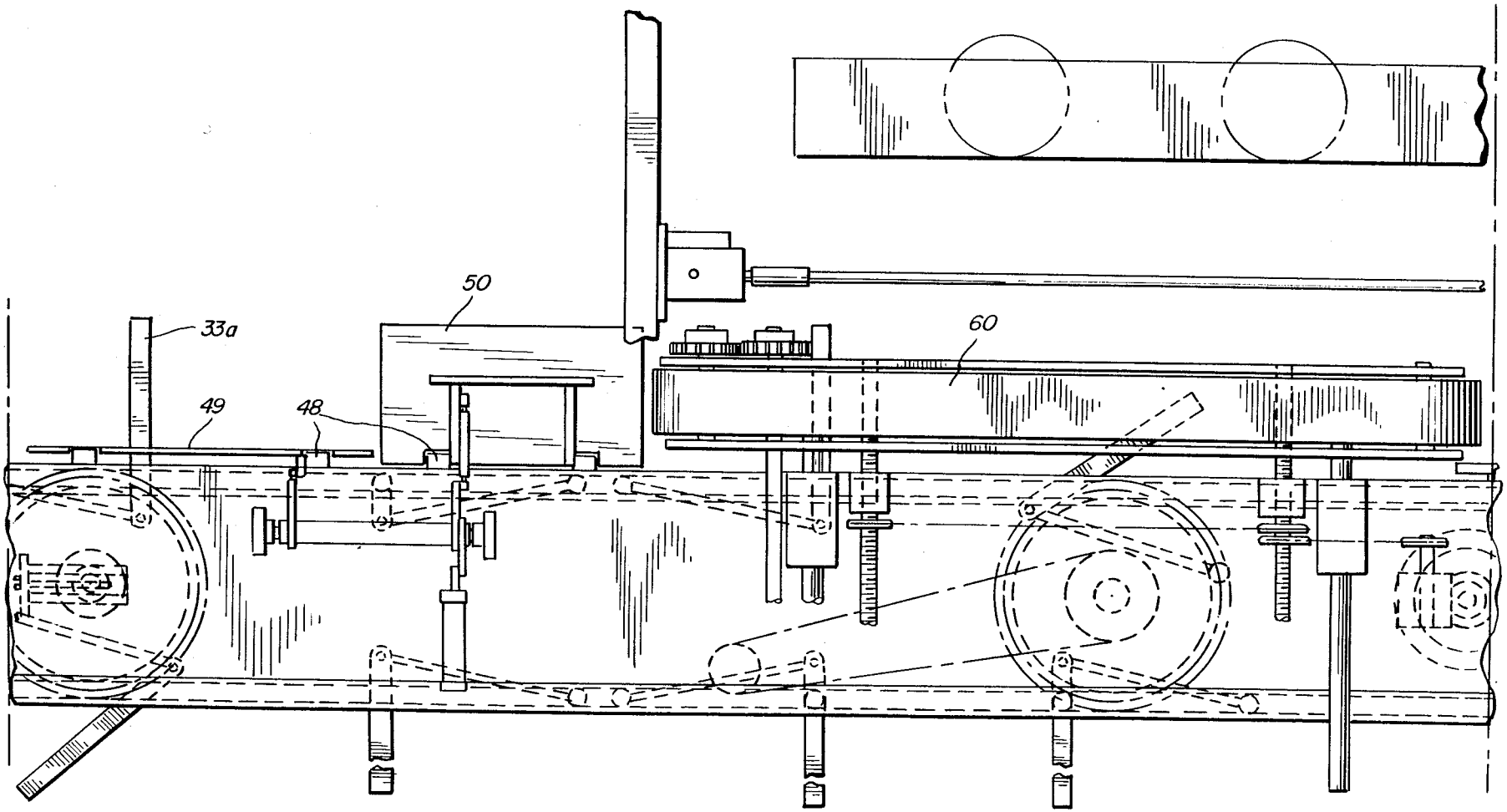
Figure 6C:
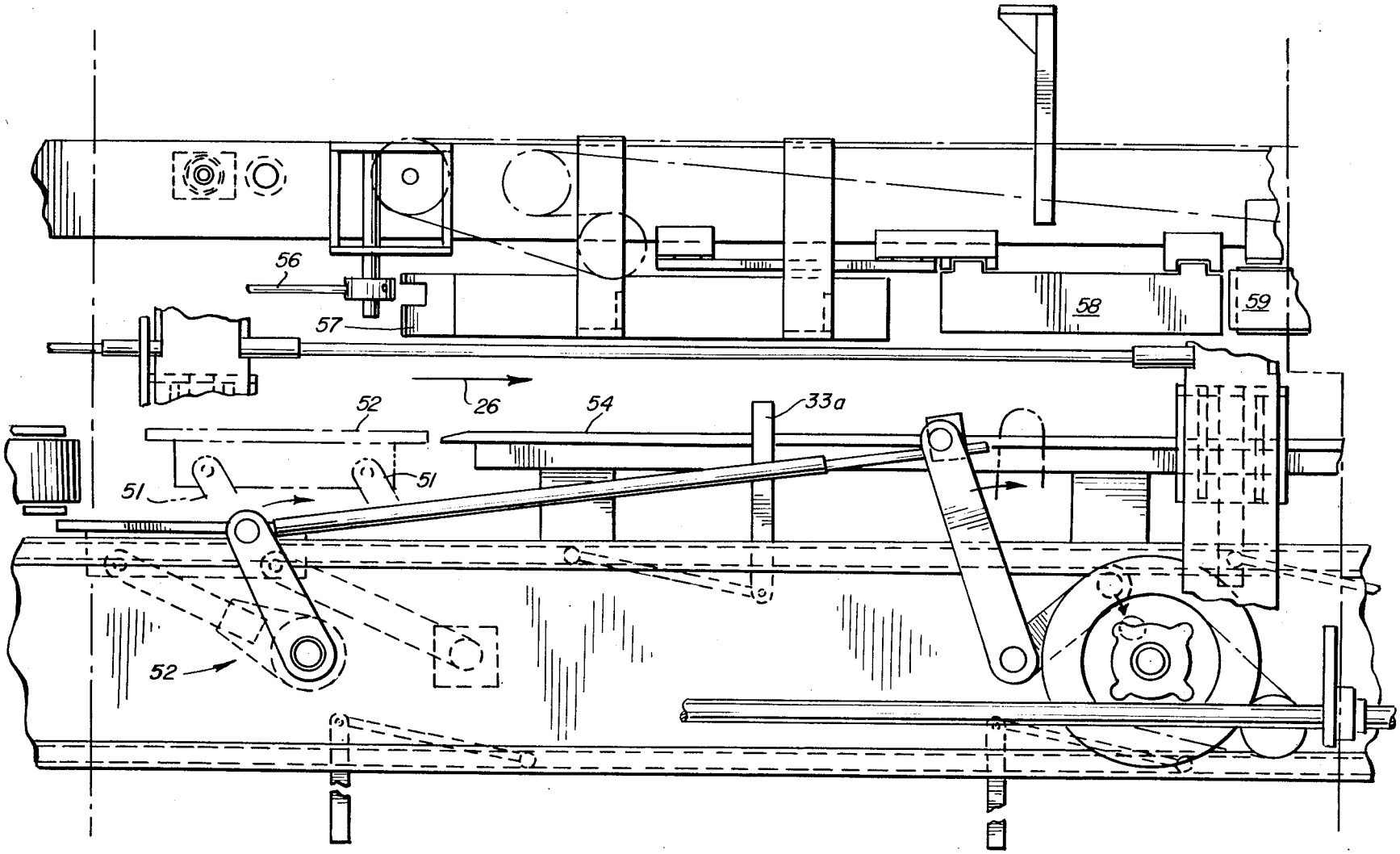

The platform 41 deposits the blank 10*a* and the pile 9 on the horizontal conveyor 33 whose pushers 33*a* advance the blank 10*a* past the stationary tucking rails 45 and into the range of pairs of pivotable folding plates 49, 50 which are hinged at 48 and convert successive blanks 10*b* into cases 2. Two of the folding plates 49, 50 (at one side of the path which is defined by the conveyor 33) are shown in FIG. 6B. The pushers 33*a* of the conveyor 33 ensure predictable transport of the case 2 and the pile 9 therein onto the second platform or elevator 52 which is shown in FIG. 6C. The platform 52 is mounted on links 51 and is movable up and down by a mechanism 53 so that the platform 52 can raise the case 2 thereon to a level above the conveyor 33 where the case 2 can advance along a horizontal track 54 under the action of the pushers 33*a*.

Figure 7B:
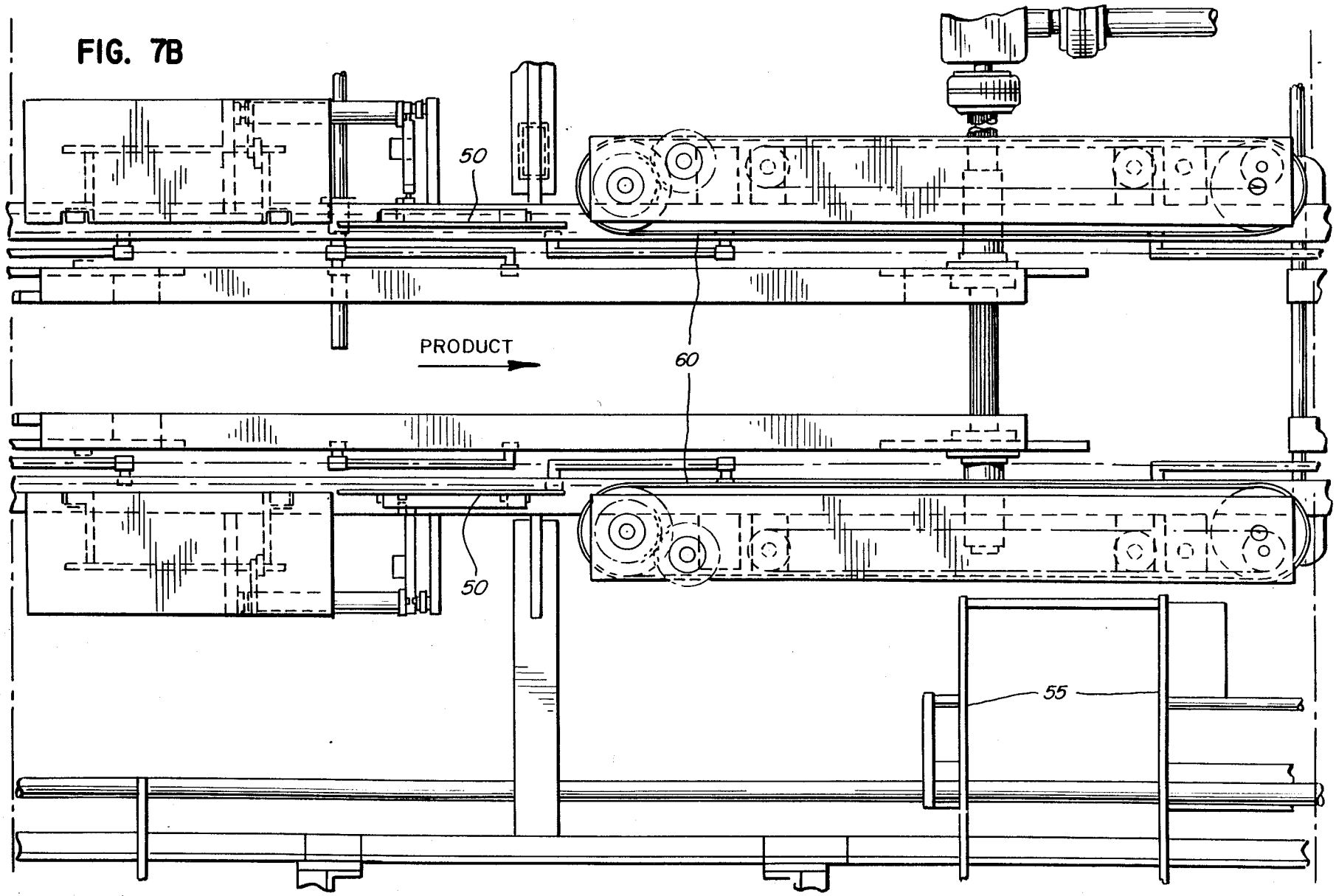
Figure 7C:
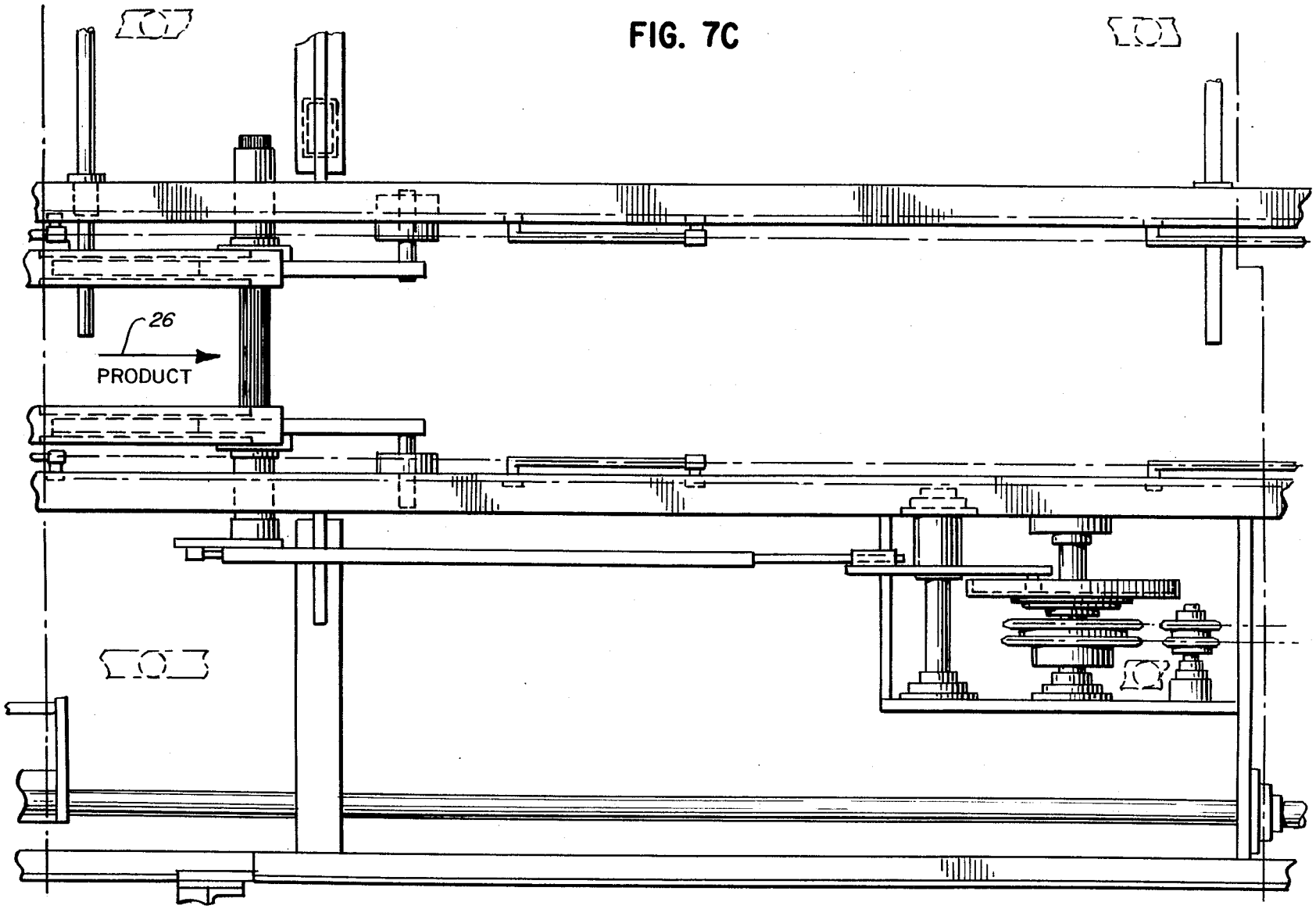
Figure 7D:
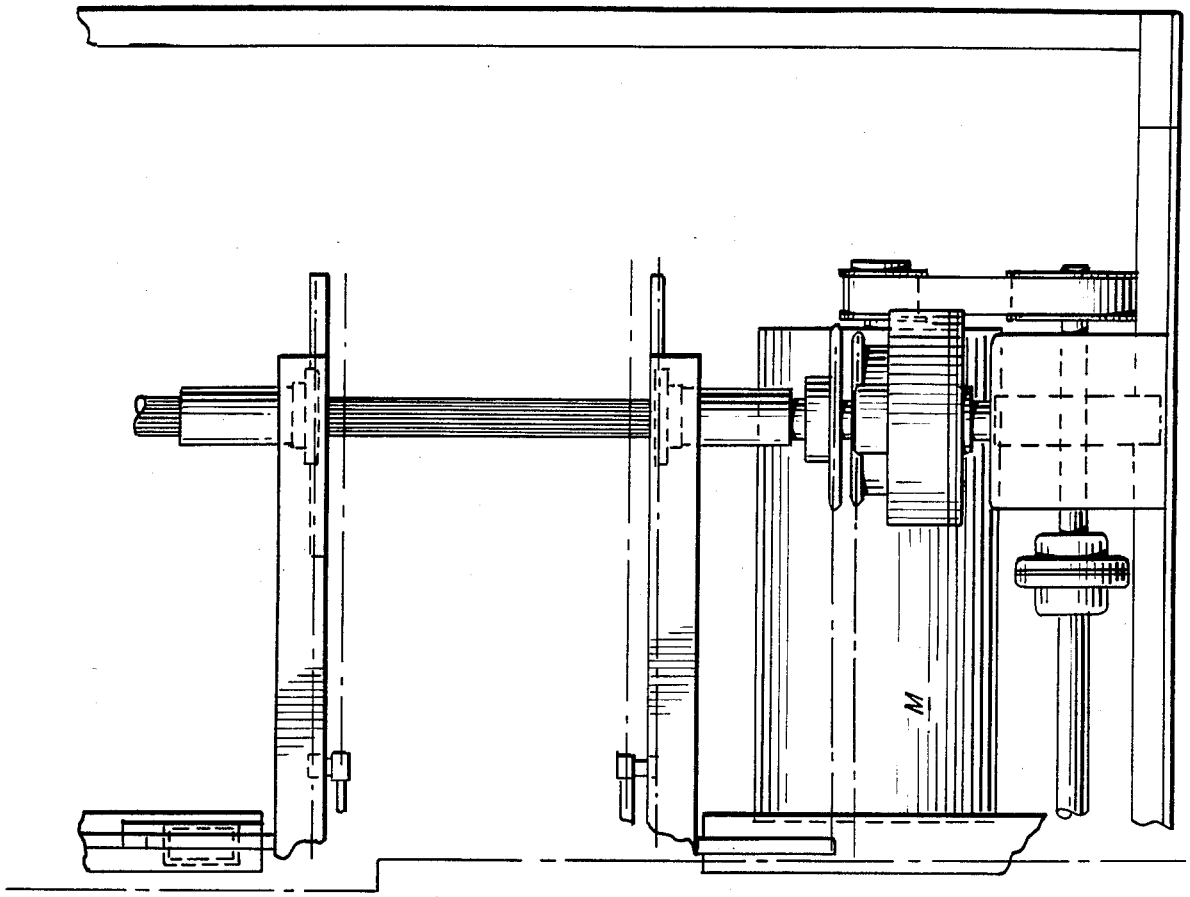

The pile 9 in the case 2 which is being lifted by the second platform 52 then receives or is already overlapped by a blank 19 which is supplied by the respective hopper 20 in the same way as described in connection with FIGS. 11 to 13. FIG. 7B shows the guide rails 55 for the blanks 19 which are being transported to the station 18 of FIG. 2 or to a station immediately ahead of the station 18.

A series of overhead folding members 76 on a conveyor 75 shown in FIG. 4 fold the front and rear flaps 4 of the blank 19 downwardly (arrows 25 in FIG. 2) while the platform 52 rises to the position of FIG. 6C so that the originally flat or nearly flat blank 19 is converted into the blank 19*a*. In the next step, and while the case 2 advances along the track 54, two turnable substantially L-shaped tucking fingers 56 (FIGS. 6C and 8B) fold the lateral end portions of the rear flap 4 of the blank 19*a*, and two stationary tucking rails 57 (FIGS. 6C and 8B) fold the lateral end portions of the front flap 4 of the blank 19 so that the latter is converted into the blank 19*b*. In the next step, pairs of pivotable folding plates 58, 59 (two shown in FIG. 6C) fold down the lateral flaps 4 of the blank 19*b* so that such blank is converted into a finished upper receptacle or lid 3.

Strips or patches of suitable adhesive (preferably a hotmelt) are applied to the lateral end portions of the upturned sidewalls 5 of successive blanks 10*a* as well as to the inner sides of the lateral sidewalls 5 of such blanks so as to ensure that the cases 2 will retain their shapes, i.e., that the lateral sidewalls 5 will reliably adhere to the adjacent outer sides of the respective end portions of the front and rear sidewalls 5. The same holds true for the lateral end portions of the front and rear flaps 4 and for the inner sides of the lateral flaps 4 of the lids 2, i.e., such parts are also coated with adhesive to thus ensure that the respective lids will retain their shape. The flaps 4 need not and normally are not bonded to the upper portions of the respective sidewalls 5 of the case 2.

Figure 6D:
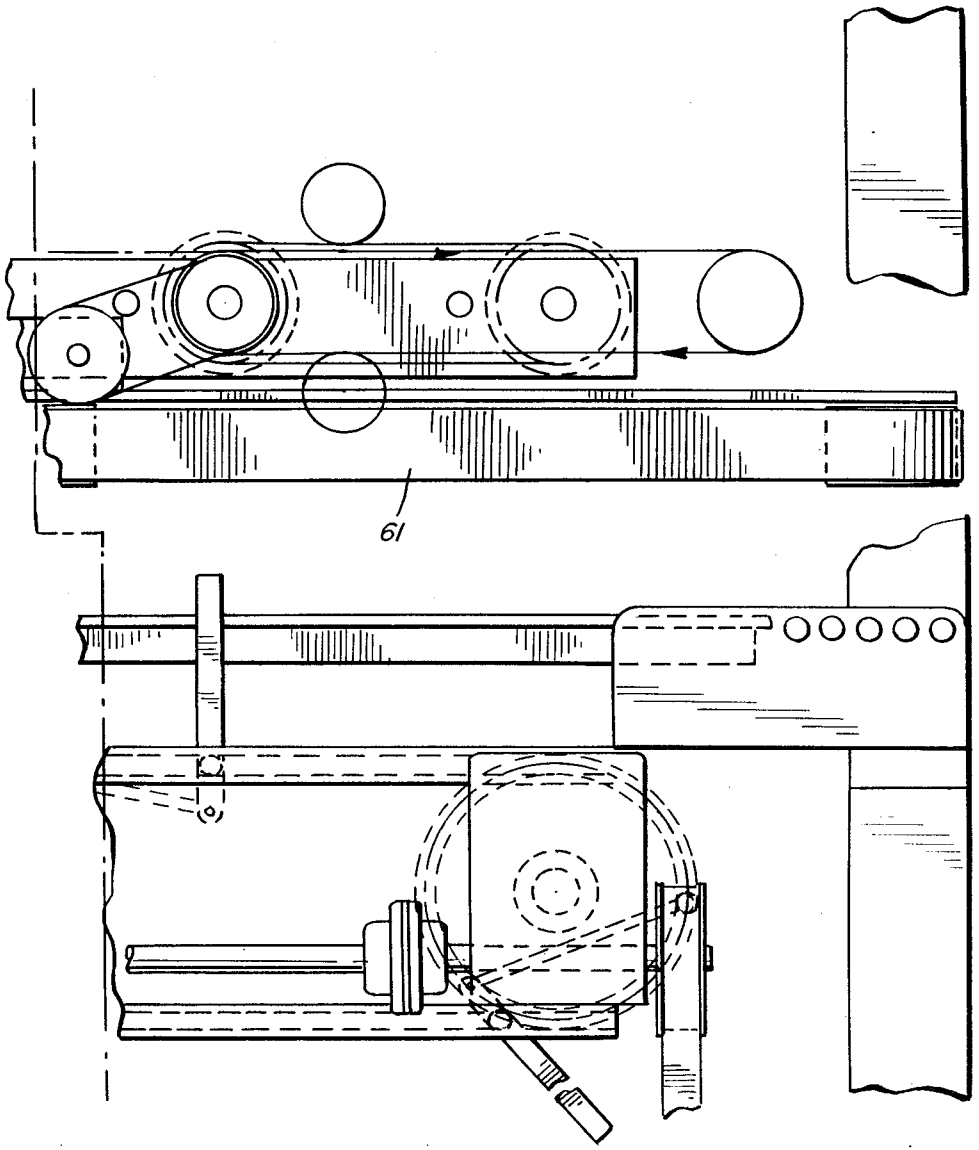

Lateral conveyors 60 (FIGS. 6B and 7B) are provided to prevent opening of the cases 2 during travel toward the second platform 52. These conveyors can bear against the lateral sidewalls 5 of the cases 2 with a variable force to thus ensure that the adhesive can set before the respective cases begin to move to a higher level. Analogous lateral conveyors 61 (FIGS. 6D and 8C) are provided to prevent opening up of the lids 3 during transport toward the discharge end or outlet of the apparatus. The pressure with which the lateral conveyors 61 bear against the adjacent lateral flaps 4 of successive lids 3 is also adjustable to account for differences in the rigidity of the material of the blanks 19, for the nature of selected adhesive and/or other variables.

Figure 8A:
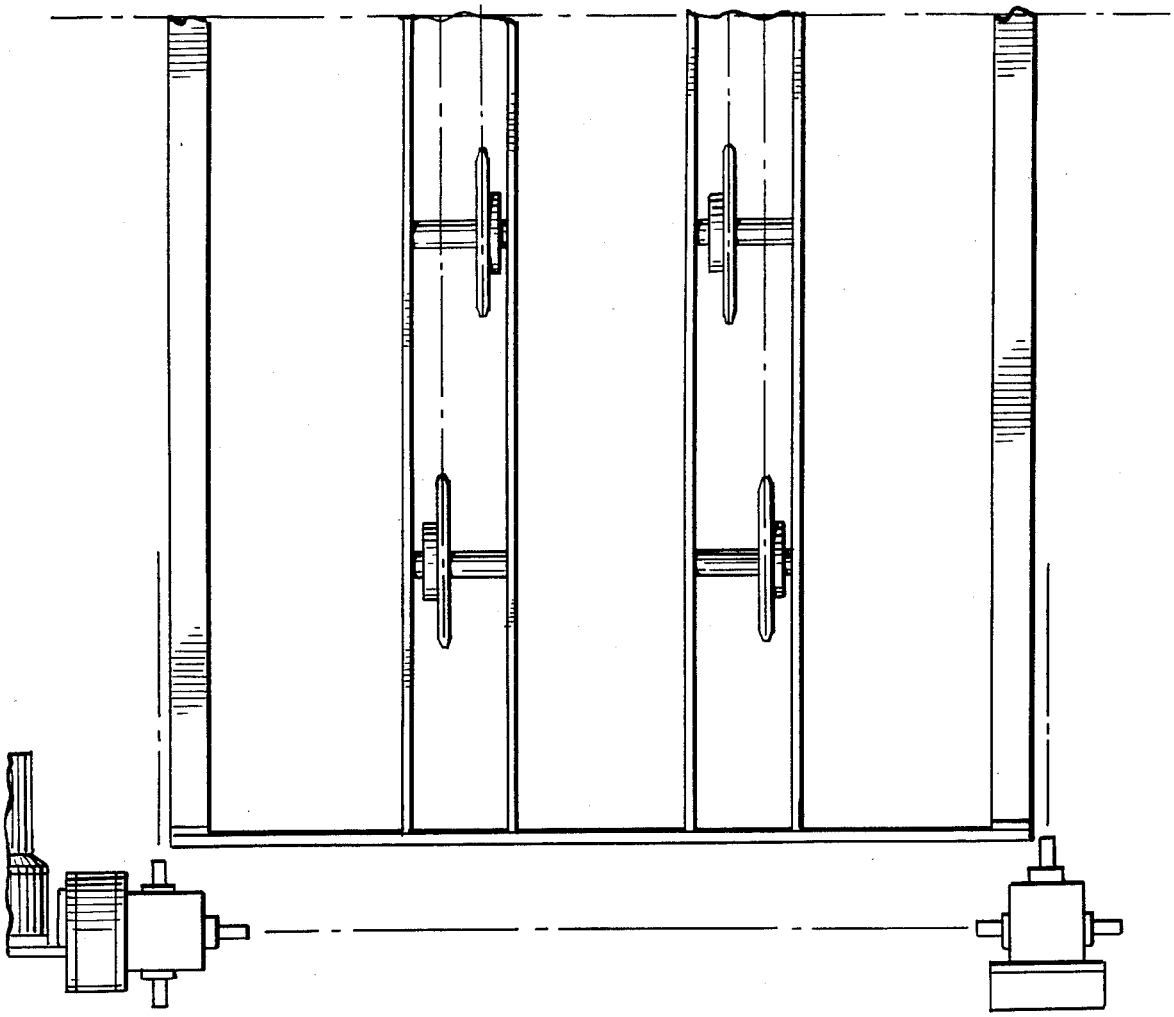
FIGS. 8A, 8B and 8C are fragmentary plan views of the apparatus.
Figure 8B:
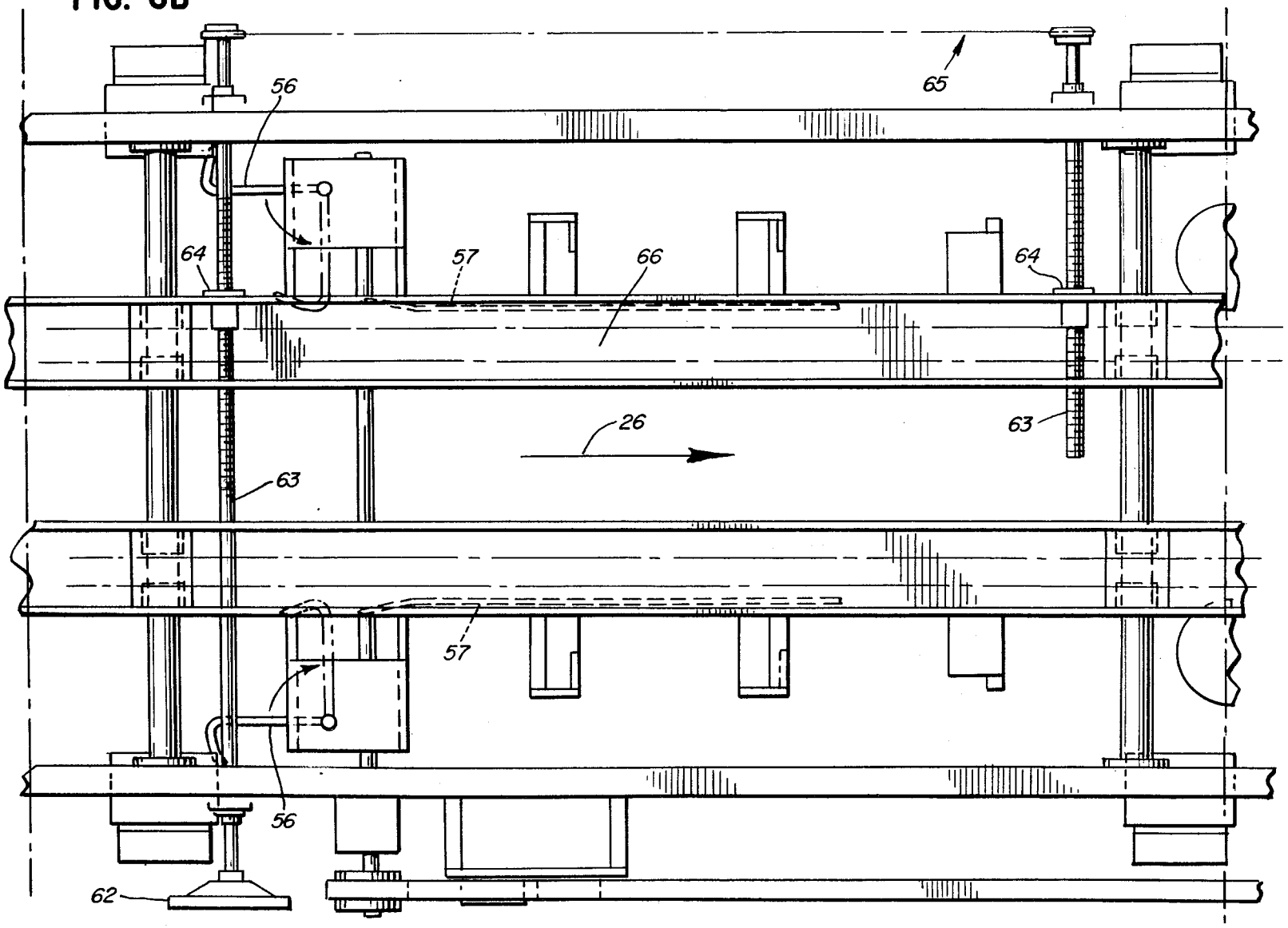
Figure 8C:
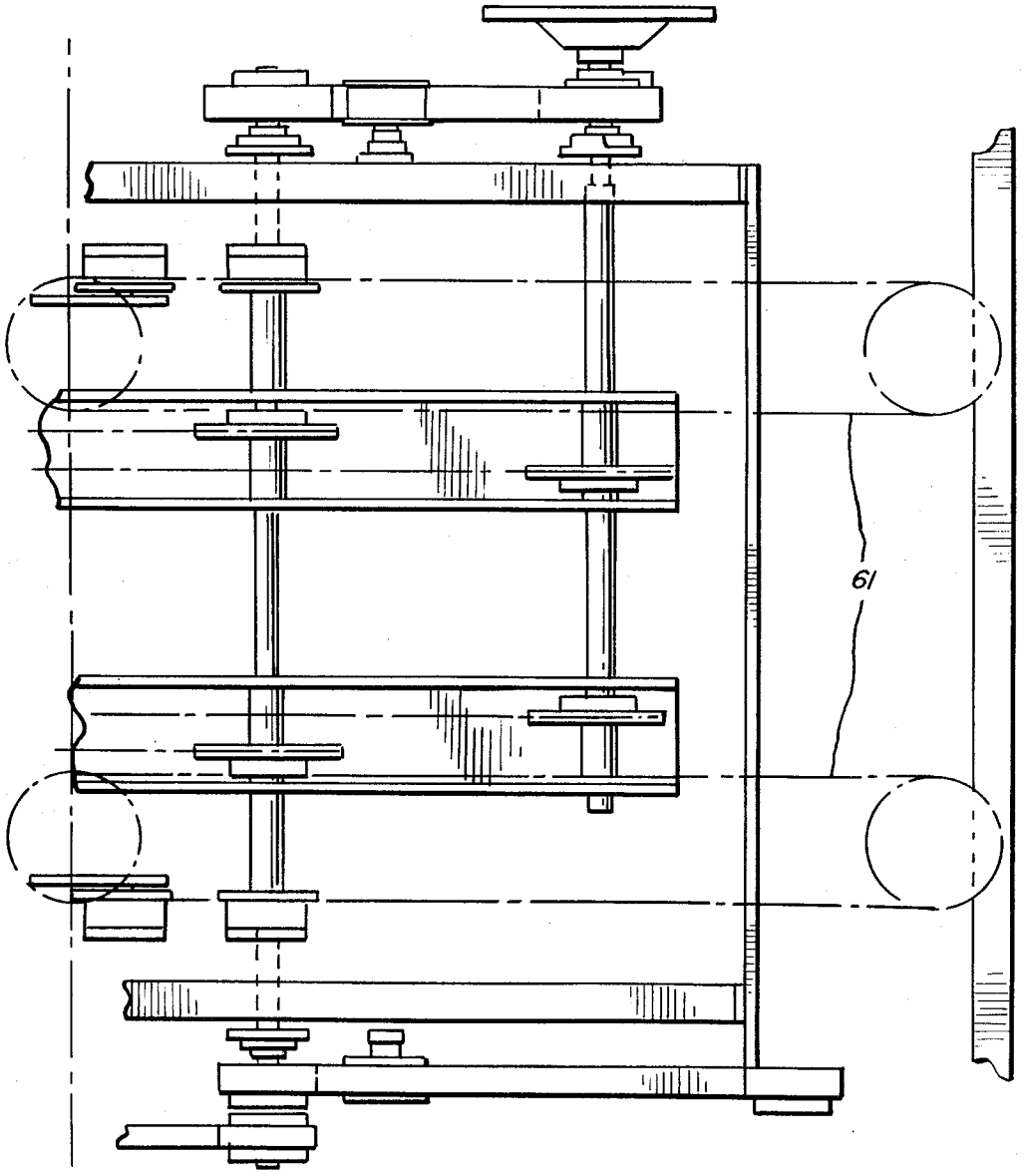

The effective width of the improved apparatus is adjustable so that it can accept wider or narrower piles or that it can accept two piles next to each other. FIG. 8B shows, by way of example, the manner in which the width of the path for advancement of cases 2 with piles 9 therein from the second elevator 52 to the box evacuating station of the apparatus can be altered by means of a handwheel 62, two feed screws 63 which mate with nuts 64 in the adjustable portion of the track for the cases 2, and a transmission 65 between the two feed screws. Adjustment of the mobile part 66 of the track for the cases 2 entails a corresponding adjustment of the tucking instrumentalities 56, 57 at the respective side of the apparatus.

Figure 5:
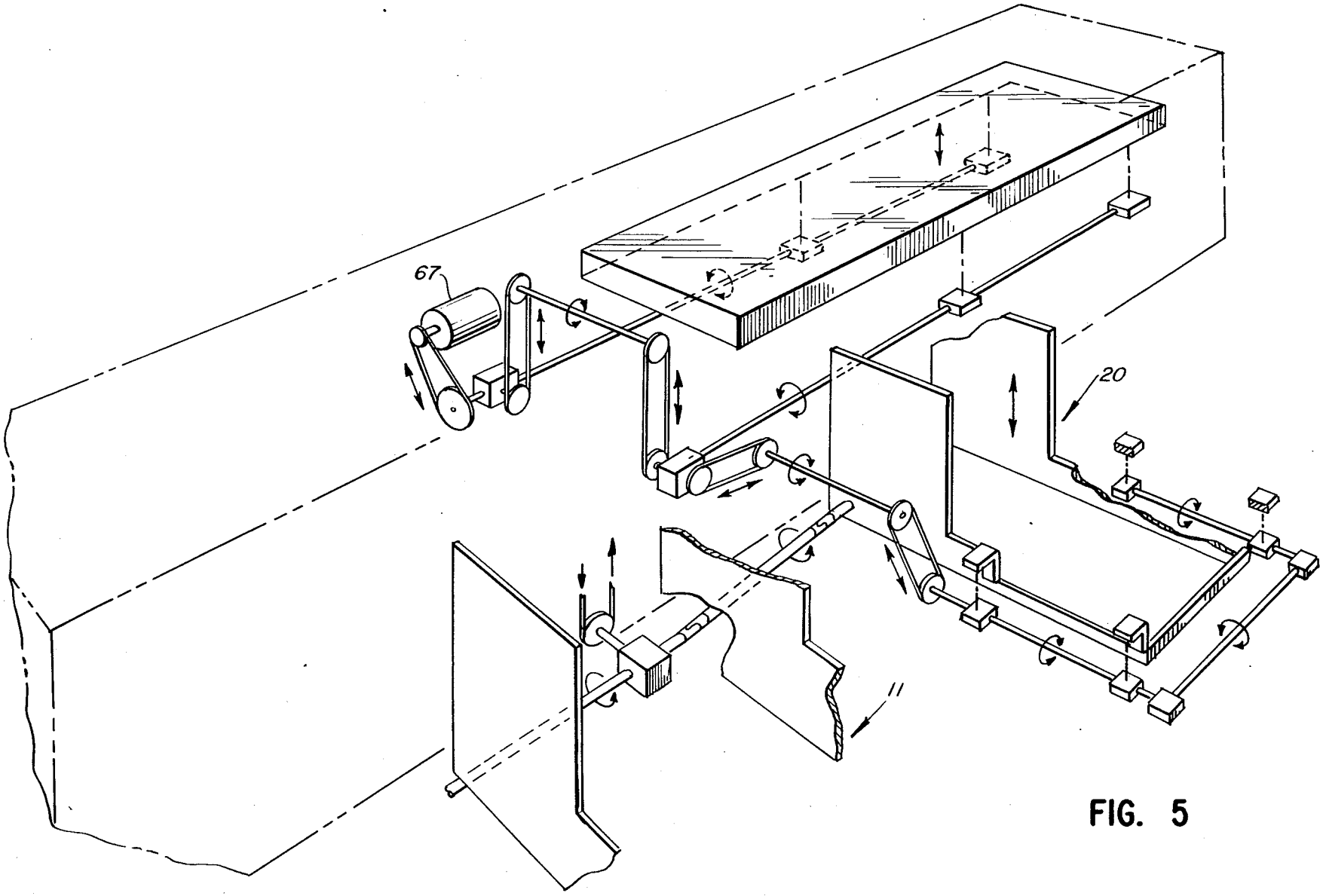
FIG. 5 is a perspective view of certain other details in the apparatus which embodies the structure of FIG. 4A.

The height of the path for the piles 9 or pairs of piles 9 is also adjustable. This is shown schematically in FIG. 5 wherein an air motor 67 can change the level of certain constituents of the apparatus in order to account for changes in the height of piles.

The width of the hoppers 11 and 20 is adjustable so that such hoppers can receive larger or smaller, wider or narrower blanks 10 and 19. FIG. 11 shows a handwheel 68 which can be manipulated to change the effective width of the magazine for storage of a supply of blanks 10 which are held in substantially vertical planes and which can advance toward the stop 35 of FIG. 12 under the action of a pusher or by gravity feed.

Figure 4A:
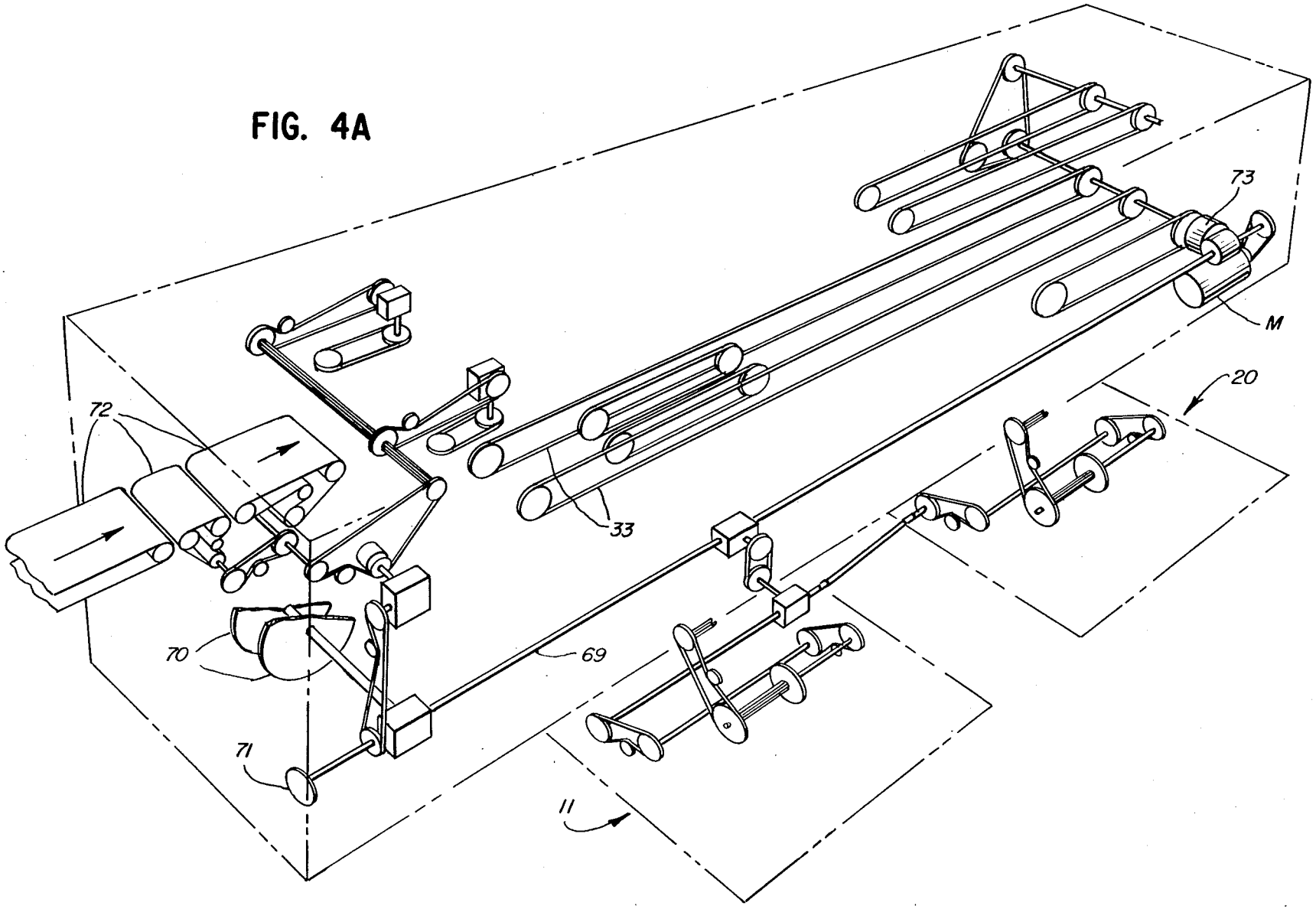
FIG. 4A is a perspective view of certain elements of the drive means in the apparatus which can be used for the practice of the improved method.
Figure 9:
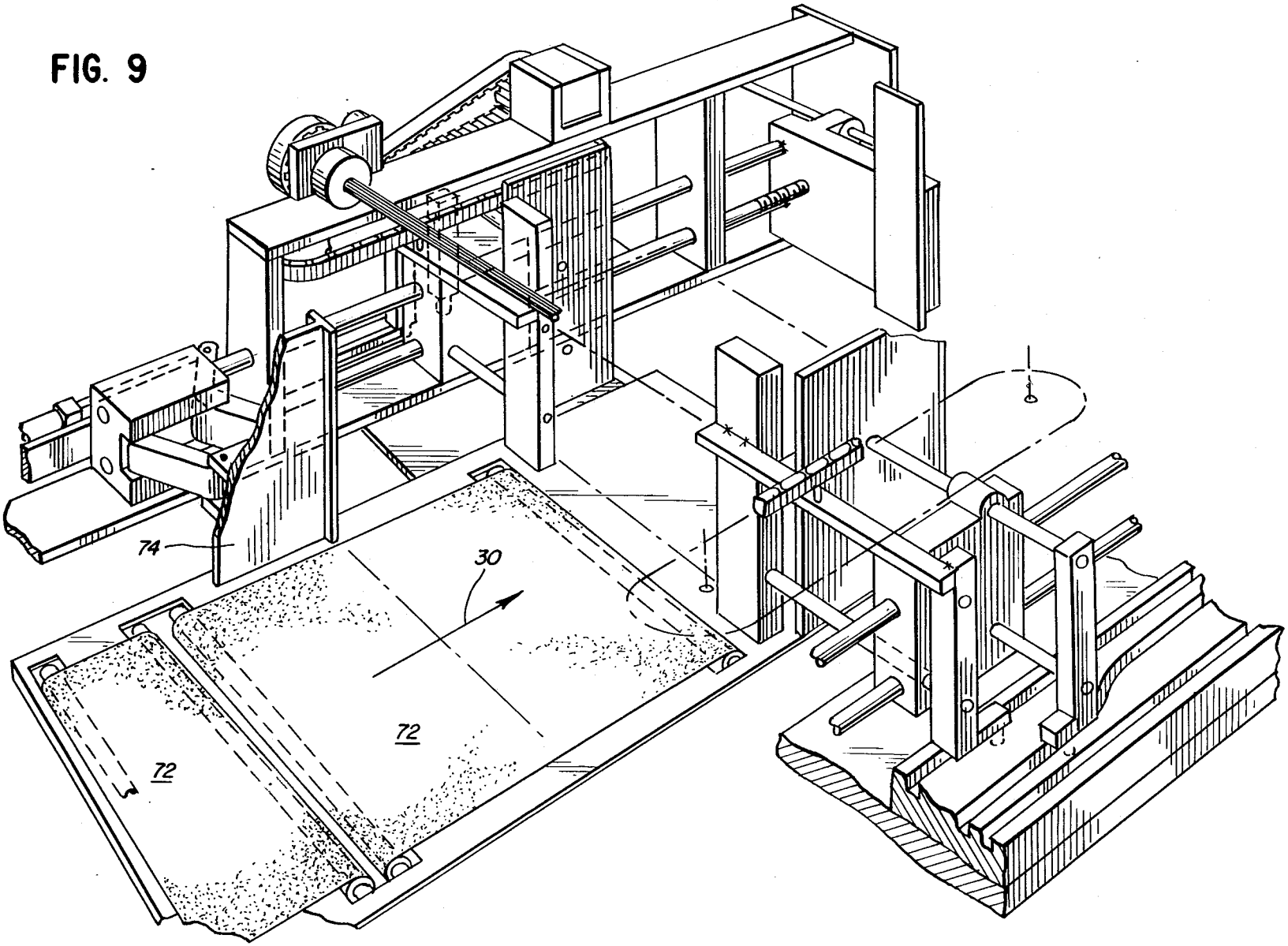
FIG. 9 is a fragmentary perspective view of the inlet portion of the apparatus.

FIG. 4A shows the main prime mover M of the apparatus, the main shaft 69, the main cams 70, a manual machine cycle handwheel 71 and several floor conveyors 71 for the piles 9 which advance from the ream stacker/accumulator 8 toward the station 29. A clutch 73 is interposed between the output element of the prime mover M and the conveyor 33 which advances the product and the blanks along the paths indicated by the arrows 17 and 26. The floor conveyors 72 cooperate with the aforementioned conveyors 31, pushers 32 and adjustable guides 74 (FIG. 9) to align, square and transfer the piles 9 onto the blanks 10 at the station 29.

The apparatus is preferably further equipped with an enclosed pressurized hot glue melt system and with an operator control panel with programmable logic controller. For example, the hot melt applicator (such as Nordson Model 2000) can be installed between the hoppers 11 and 20 so that it is readily accessible at all times. The main electrical control panel can be mounted on the frame between the hopper 20 and the discharge or outlet end of the apparatus. An auxiliary control panel can be mounted on the frame adjacent to the inlet end, and an emergency stop button can be installed at each end of the apparatus. Furthermore, several warning lights (such as a low blank warning light and a machine fault warning light) can be installed on top of the frame. A machine timing dial is preferably installed behind a door adjacent to the handwheel 71. Numerous additional handwheels (such as a lidder conveyor phasing handwheel, a lidder width adjustment handwheel, a case compression height adjustment handwheel, a case conveyor width adjustment handwheel, additional conveyor and pusher phasing handwheel, a product backstop adjustment handwheel, a product stop gate and indexer adjustment handwheel, and a conveyor reset safety clutch handwheel) are preferably mounted and are accessible at that side of the frame which faces away from the two hoppers.

If the operator desires to switch from casing and lidding of single stacks or piles of reams 6 to confinement of twin stacks or piles, the illustrated platforms 41 and 52 are replaced with wider platforms. Each of the platforms 41, 52 is preferably secured to its support by means of several screws or bolts so that the replacement of platforms takes up little time.

The extent to which the operation can be automated can be selected practically at will. The various limit switches, photoelectrical detectors, mechanical sensors and/or other signal generating monitoring devices for the electrical, hydraulic and/or pneumatic systems of the apparatus are not specifically shown in FIGS. 1 to 13. The apparatus is preferably further provided with automatic decelerating and arresting means for all such parts which fail to operate properly or are likely to deface and/or otherwise damage the product.

As explained above, the conveyor 33 which transports the blanks 10*a*, 10*b* and cases 2 in the directions indicated in FIG. 2 by arrows 17, and which advances the cases 2 in the directions indicated in FIG. 2 by arrows 26 operates continuously to thus contribute to a higher output of the apparatus and to reduce the wear upon its parts.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of assembling block-shaped commodities each of which has six sides with first and second components of confining means therefor, particularly of confining arrays of paper stacks in converted blanks of carboard or the like, comprising (a) the first step of transporting successive commodities in a predetermined direction to a predetermined position at a first level;

(b) the second step of conveying successive first components into register with the respective commodities in said position;

(c) the third step of jointly moving successive commodities and the respective first components to a second level;

(d) the fourth step of advancing successive commodities and the respective first components in said direction along a first predetermined path;

(e) the fifth step of converting, not later than in the course of said fourth step, successive first components into first receptacles each of which overlies five sides of the respective commodity;

(f) the sixth step of conveying successive second components of confining means to a predetermined position of register with the oncoming commodities and the respective first receptacles in a predetermined portion of said first path;

(g) the seventh step of jointly moving the second components with the respective commodities and first receptacles to a third level;

(h) the eighth step of advancing the second components and the respective commodities and first receptacles in said predetermined direction along a second path;

(i) the ninth step of converting, in the course of said seventh and eighth steps, successive second components into second receptacles each of which overlies the sixth side of the respective commodity and each of which further overlies the respective first receptacle at four sides of the respective commodity; and (j) the tenth step of maintaining the commodities in a single predetermined orientation in the course of each of said first to ninth steps.

2. The method of claim 1, wherein said fourth step includes continuously advancing the commodities and the respective first components along said first path.

3. The method of claim 1, wherein said first level is above said second level.

4. The method of claim 1, wherein said third level is above said second level.

5. The method of claim 1, further comprising the step of guiding successive commodities in the course of said first step so that each such commodity is transported to the same predetermined position.

6. The method of claim 1, wherein said second step includes changing the orientation of successive first components during conveying toward the positions of register with the respective commodities.

7. The method of claim 1, wherein said second step includes changing the orientation of successive first components through between 75 and 105 degrees, including moving each of said first components from a substantially vertical plane into a substantially horizontal plane.

8. The method of claim 7, wherein said second step further includes moving successive first components in said horizontal plane toward the positions of register with the respective commodities.

9. The method of claim 1, wherein said sixth step includes changing the orientation of second components during conveying toward said predetermined portion of said first path.

10. The method of claim 1, wherein said eighth step includes uninterruptedly advancing the commodities, the respective first receptacles and the respective second components along said second path.

11. The method of claim 1, wherein said sixth step includes changing the orientation of successive second components through approximately 90 degrees, including moving each of said second components from a substantially vertical plane into a substantially horizontal plane.

12. The method of claim 11, wherein said sixth step further includes moving successive second components in said horizontal plane toward a predetermined portion of said first path.

13. The method of claim 1, wherein at least one of said paths is at least substantially horizontal.

14. The method of claim 1, further comprising the step of bonding each second receptacle to the corresponding first receptacle.

15. Apparatus for assembling blcok-shaped commodities each of which has six sides with first and second components of confining means therefor, particularly for confining arrays of paper stacks in converted blanks of cardboard or the like, comprising (a) means for transporting successive commodities of a series of such commodities in a predetermined direction to a predetermined position at a first level;

(b) means for conveying successive first components of a series of first components into register with successive commodities in said predetermined position;

(c) means for jointly moving successive commodities and the respective first components from said first level to a different second level;

(d) means for advancing successive commodities and the respective first components in said predetermined direction along a first predetermined path;

(e) means for converting, not later than in said first path, successive first components into first receptacles each of which overlies five sides of the respective commodity;

(f) means for conveying successive second components of a series of second components to a predetermined position in a predetermined portion of said first path downstream of said converting means (e) so that each second component is in register with the oncoming commodity and the respective first receptacle;

(g) means for jointly moving successive second components with the corresponding first receptacles and commodities from said second level to a different third level;

(h) means for advancing successive second components, together with the corresponding first receptacles and commodities, in said predetermined direction along a second path; and (i) means for converting in said seventh and eighth paths successive second components into second receptacles each of which overlies the sixth side of the respective commodity as well as the respective first receptacle at four sides of the respective commodity, (j) said transporting, moving and advancing means including means for maintaining the commodities in unchanged orientation.

16. The apparatus of claim 15, wherein said means (f) comprises means for changing the orientation of second components on their way toward said predetermined portion of said first path.

17. The apparatus of claim 16, wherein said orientation changing means comprises means for moving successive second components from a substantially vertical plane into a substantially horizontal plane.

18. The apparatus of claim 17, wherein said means (f) further comprises means for conveying successive second commodities in said horizontal plane toward and into said predetermined portion of said first path.

19. The apparatus of claim 15, wherein said means (f) comprises means for placing successive second components of the respective series on top of the respective commodities.

20. The apparatus of claim 15, wherein said conveying means (b) comprises means for placing successive first components of the respective series below the respective commodities.

21. The apparatus of claim 15, wherein said means (e) comprises means for lowering successive commodities and the respective components from said first to said second level.

22. The apparatus of claim 15, wherein said first path is at least substantially horizontal.

23. The apparatus of claim 15, further comprising guide means cooperating with said means (a) to ensure that each of said series of commodites is transported to the same predetermined position.

24. The apparatus of claim 15, wherein said means (e) includes a portion which is adjacent to said means (c) so that a portion of each component is converted into a position of the respective receptacle during movement with the respective commodity from said first to said second level.

25. The apparatus of claim 15, wherein said means (d) includes means for continuously advancing successive commodities and the respective first components along said first path.

26. The apparatus of claim 15, wherein said second level is below said first level.

27. The apparatus of claim 15, wherein said conveying means (b) comprises means for changing the orientation of successive first components on their way toward positions of register with the respective commodities.

28. The apparatus of claim 27, wherein said orientation changing means comprises means for moving successive first components from a substantially vertical plane into a substantially horizontal plane.

29. The apparatus of claim 28, wherein said conveying means (b) further comprises means for conveying successive first components in said horizontal plane toward positions of register with the respective commodities.

30. The apparatus of claim 15, wherein said conveying means (b) includes means for placing successive first components on top of the respective commodities.

31. The apparatus of claim 15, further comprising a source of supply of commodities, and means for singularizing commodities of the respective series between said source and said first named predetermined position.

32. The apparatus of claim 15, wherein said means (h) includes means for uninterruptedly advancing successive second coponents, together with the corresponding first receptacles and commodities, along said second path.

33. The apparatus of claim 15, wherein said means (g) comprises means for lifting successive second components, together with the corresponding first receptacles and commodities, from said second to said third level.

34. The apparatus of claim 15, wherein said second path is at least substantially horizontal.

35. The apparatus of claim 15, wherein said means (i) comprises a portion which is adjacent to said moving means (g) so that a portion of each second component is converted into a portion of the respective second receptacle during movement with the respective commodity and first receptacle from said second to said third level.

* * * * *